US008465897B2

(12) United States Patent
Aoki et al.

(10) Patent No.: US 8,465,897 B2
(45) **Date of Patent: *Jun. 18, 2013**

(54) ELECTROPHOTOGRAPHIC TONER

(75) Inventors: Takayasu Aoki, Shizuoka-ken (JP); Yasuhito Noda, Shizuoka-ken (JP); Koji Imamiya, Kanagawa-ken (JP); Tsuyoshi Itou, Shizuoka-ken (JP); Noboru Furuyama, Kanagawa-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 147 days.

This patent is subject to a terminal disclaimer.

(21) Appl. No.: 13/097,226

(22) Filed: Apr. 29, 2011

(65) Prior Publication Data

US 2011/0212397 A1 Sep. 1, 2011

Related U.S. Application Data

(63) Continuation-in-part of application No. 12/950,158, filed on Nov. 19, 2010.

(60) Provisional application No. 61/263,499, filed on Nov. 23, 2009, provisional application No. 61/323,613, filed on Apr. 13, 2010.

(51) Int. Cl.
*G03G 9/08* (2006.01)

(52) U.S. Cl.
USPC ..... 430/109.4; 430/108.1; 399/252

(58) Field of Classification Search
USPC ..... 430/109.4, 108.1; 399/252
See application file for complete search history.

(56) References Cited

U.S. PATENT DOCUMENTS

| | | | |
|---|---|---|---|
| 6,203,603 | B1 | 3/2001 | Takayama et al. |
| 6,329,317 | B1 | 12/2001 | Takayama et al. |
| 2007/0207402 | A1 | 9/2007 | Takagi et al. |
| 2008/0227015 | A1 | 9/2008 | Nagatomo et al. |
| 2010/0209839 | A1 | 8/2010 | Kabai et al. |
| 2011/0262857 | A1 | 10/2011 | Aoki et al. |

FOREIGN PATENT DOCUMENTS

| | | |
|---|---|---|
| EP | 0980028 | 2/2000 |
| EP | 2219081 | 8/2010 |
| JP | 05-072800 | 3/1993 |
| JP | 2000-019770 | 1/2000 |
| JP | 2001-188381 | 7/2001 |
| JP | 2003-114587 | 4/2003 |
| JP | 2008-233806 | 10/2008 |
| JP | 2009-229785 | 10/2009 |

OTHER PUBLICATIONS

Japanese Office Action for Japanese Application No. 2010-261338 mailed on Oct. 30, 2012.
Korean Office Action for Korean Application No. 10-2010-116169 mailed on May 31, 2012.
European Extended Search Report for European Application No. 10191748.2 mailed Jun. 28, 2012.

*Primary Examiner* — Mark A Chapman
(74) *Attorney, Agent, or Firm* — Turocy & Watson, LLP

(57) ABSTRACT

An electrophotographic toner, which is decolorized by heating and a glossiness after decolorization of which is less than 10, comprising an electron donating color former compound, an electron accepting color developing agent, and a polyester binder resin.

23 Claims, 10 Drawing Sheets

FIG. 2

| | EXAMPLE 1 | EXAMPLE 2 | EXAMPLE 3 | EXAMPLE 4 | EXAMPLE 5 | EXAMPLE 6 | COMPARATIVE EXAMPLE 1 | COMPARATIVE EXAMPLE 2 |
|---|---|---|---|---|---|---|---|---|
| WEIGHT AVERAGE MOLECULAR WEIGHT | 6300 | 7500 | 14000 | 24000 | 10000 | 8000 | 5800 | 27000 |
| ACID VALUE OF TONER (mgKOH/g) | 15 | 12 | 15 | 19 | 5 | 23 | 10 | 29 |
| GLASS TRANSITION POINT OF TONER (°C) | 50 | 60 | 62 | 60 | 37 | 60 | 45 | 70 |
| SOFTENING POINT OF TONER (°C) | 95 | 90 | 100 | 115 | 82 | 101 | 77 | 130 |
| TOLUENE INSOLUBLE CONTENT (% BY MASS) | 20 | 12 | 24 | 37 | 15 | LESS THAN 5 | LESS THAN 5 | 45 |
| FIXING TEMPERATURE (°C) | 85 | 90 | 95 | 95 | - | 90 | 80 | 120 |
| DECOLORIZATION TEMPERATURE (°C) | 120 | 120 | 120 | 120 | - | 120 | 120 | - |
| GLOSSINESS IN DECOLORIZED REGION | 9 | 8 | 6 | 5 | - | 20 | 35 | - |

FIG. 3

| | | EXAMPLE 7 | EXAMPLE 8 | EXAMPLE 9 | EXAMPLE 10 | EXAMPLE 11 | EXAMPLE 12 | EXAMPLE 13 | EXAMPLE 14 |
|---|---|---|---|---|---|---|---|---|---|
| GLASS TRANSITION POINT OF TONER (°C) | | 48 | 25 | 65 | 48 | 48 | 48 | 48 | 48 |
| NUMBER OF TYPES OF INORGANIC FINE PARTICLES | | 2 | 2 | 2 | 1 | 1 | 1 | 2 | 2 |
| AVERAGE PRIMARY PARTICLE DIAMETER OF INORGANIC FINE PARTICLES (nm) | 1ST TYPE | 40 | 40 | 40 | 15 | 230 | 100 | 40 | 22 |
| | 2ND TYPE | 100 | 100 | 100 | - | - | - | 100 | 100 |
| COVERAGE WITH FINE PARTICLES HAVING AN AVERAGE PRIMARY PARTICLE DIAMETER OF 50 nm OR MORE AND 200 nm OR LESS ALONE (%) | | 18 | 18 | 12 | 0 | 0 | 56 | 8 | 27 |
| COVERAGE WITH ALL OF FINE PARTICLES (%) | | 95 | 95 | 65 | 145 | 53 | 56 | 45 | 180 |
| STORAGE STABILITY | | A | C | A | B | B | B | C | B |
| GLOSSINESS IN DECOLORIZED REGION | | A | C | A | C | A | A | A | A |
| LOW-TEMPERATURE FIXABILITY | | A | A | C | A | A | A | A | B |
| PRINTING DURABILITY | | A | C | B | A | C | C | C | C |

FIG.4

| | Example 15 | Example 16 | Example 17 | Comparative Example 3 | Comparative Example 4 |
|---|---|---|---|---|---|
| Weight average molecular weight | 8200 | 7500 | 8500 | 7500 | 5800 |
| Content of trimellitic acid (wt%) | 12 | 15 | 5 | 0 | 0 |
| Toluene insoluble content (%) | 35 | 28 | 20 | 15 | 12 |
| Fixing temperature (C) | 90 | 88 | 85 | 85 | 80 |
| Decolorization temperature (C) | 120 | 120 | 120 | 120 | 120 |
| Glossiness in decolorized region | 5 | 6 | 9 | 12 | 35 |

FIG.10

| | EXAMPLE 18 | EXAMPLE 19 | EXAMPLE 20 | EXAMPLE 21 | COMPARATIVE EXAMPLE 5 | COMPARATIVE EXAMPLE 6 |
|---|---|---|---|---|---|---|
| CONFIGURATION OF DECOLORING APPARATUS | DECOLORING APPARATUS | DECOLORING APPARATUS | IMAGE FORMING APPARATUS | DECOLORING APPARATUS | DECOLORING APPARATUS | DECOLORING APPARATUS |
| CONFIGURATION OF HEATING ROTATING MEMBER | BELT | ROLLER | BELT | BELT | BELT | BELT |
| MATERIAL OF SURFACE OF HEATING ROTATING MEMBER | SILICONE RUBBER | PTFE RESIN | SILICONE RUBBER | SILICONE RUBBER | PFA | SILICONE RUBBER |
| Rz VALUE | 4.582 | 3.895 | 4.582 | 5.651 | 3.152 | 7.352 |
| GLOSS LEVEL AFTER DECOLORING PROCESS | 7 | 9 | 7 | 6 | 15 | 5 |
| ADHESION OF DECOLORABLE COLORANT TO ROTATING MEMBER | A | A | A | A | A | B |
| OCCURRENCE OF JAM | A | A | A | A | A | B |

ELECTROPHOTOGRAPHIC TONER

CROSS-REFERENCE TO RELATED APPLICATIONS

This application is a continuation-in-part application of U.S. patent application Ser. No. 12/950,158 filed on Nov. 19, 2010, which application is based upon and claims the benefit of priority from: U.S. provisional application 61/263,499, filed on Nov. 23, 2009; and U.S. provisional application 61/323,613, filed on Apr. 13, 2010; the entire contents all of which are incorporated herein by reference.

FIELD

Embodiments described herein relate to a technique for a decolorizable toner which is decolorized by heating.

BACKGROUND

Conventionally, in order to enable the reuse of paper used for printing or note-taking for the purpose of temporal transfer, display, or the like of information, a heat-sensitive recording medium (heat-sensitive paper) capable of erasing printing by heating, or a pigment or the like, which is decolorized by heating, is used.

Further, as a toner for an image forming apparatus such as a multifunction peripheral (MFP), a so-called decolorizable toner, which is decolorized by heating, is also used. A sheet having an image formed thereon using the decolorizable toner can be reused after the image is decolorized because the toner is decolorized by heating.

However, the conventional decolorizable toner has problems that the decolorization performance is not sufficient, and for example, a gloss in a region where an image formed on a sheet was decolorized is noticeable, and so on.

DESCRIPTION OF THE DRAWINGS

FIG. 2 is a table showing evaluation of toners of Examples and Comparative Examples according to a first embodiment.

FIG. 3 is a table showing evaluation of toners of Examples according to a second embodiment.

FIG. 4 is a table showing evaluation of toners of Examples and Comparative Examples according to a third embodiment.

FIG. 10 is a table of test results.

DETAILED DESCRIPTION

Figure 1:
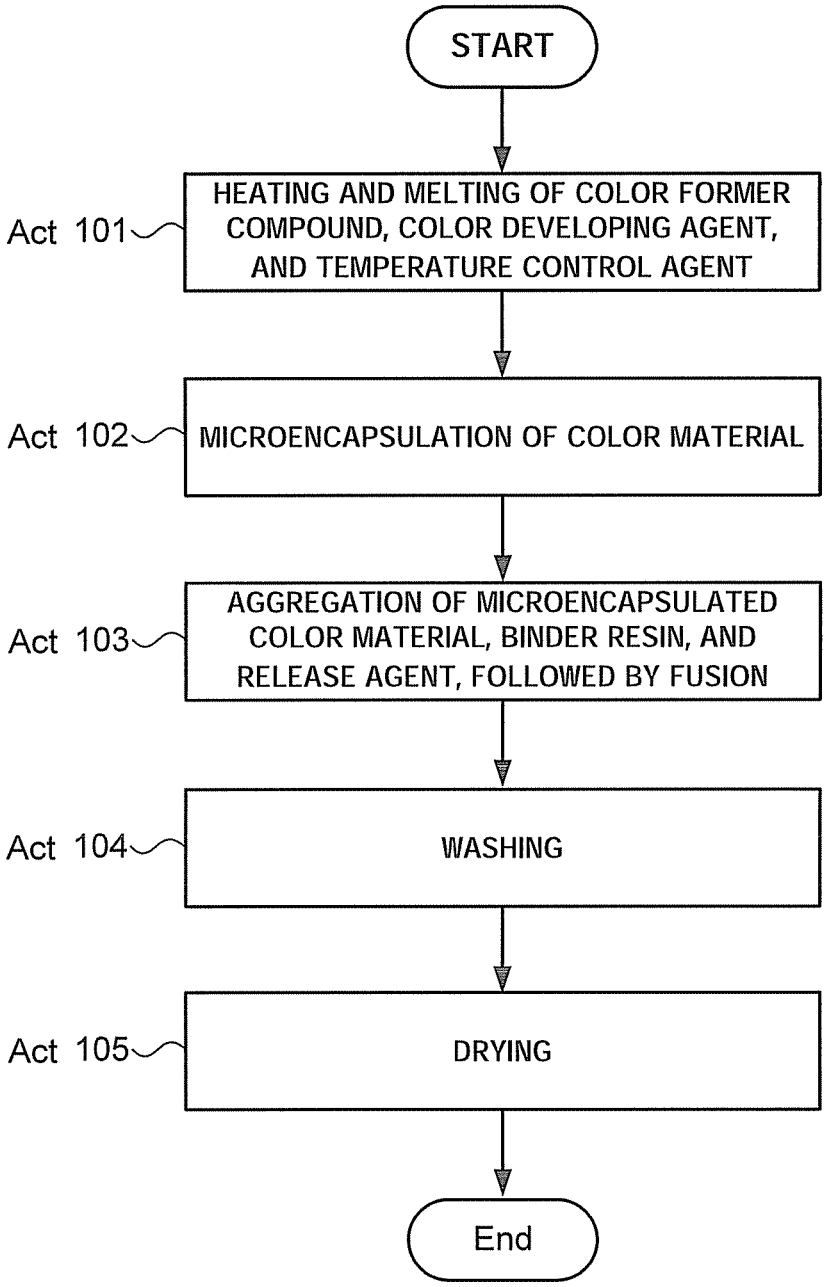
FIG. 1 is a flow chart showing a flow of a process for producing a toner.

In general, according to an embodiment, an electrophotographic toner contains an electron donating color former compound, an electron accepting color developing agent and a polyester binder resin. And the toner is decolorized by heating and a glossiness after decolorization of which is less than 10.

Hereinafter, embodiments will be described with reference to the drawings.

First Embodiment

An electrophotographic toner according to this embodiment is a so-called decolorizable toner which is decolorized by heating.

The toner according to this embodiment contains at least an electron donating color former compound, an electron accepting color developing agent, and a binder resin. The binder resin is a polyester resin and has a weight average molecular weight Mw measured by gel permeation chromatography (GPC) of 6000 or more and 25000 or less.

The electron donating color former compound is a dye precursor compound to be used for displaying characters, figures, etc. As the electron donating color former compound, a leuco dye can be mainly used. The leuco dye is an electron donating compound capable of developing a color by the action of a color developing agent, and examples thereof include diphenylmethane phthalides, phenylindolyl phthalides, indolyl phthalides, diphenylmethane azaphthalides, phenylindolyl azaphthalides, fluorans, styrynoquinolines, and diaza-rhodamine lactones.

Specific examples thereof include 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl)quinoline, spiro[5H-(1)benzopyrano(2,3-d)pyrimidine-5,1'(3'H)isobenzofuran]-3'-one, 2-(diethylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-methyl-, spiro[5H-(1)benzopyrano(2,3-d)pyrimidine-5,1'(3'H)isobenzofuran]-3'-one, 2-(di-n-butylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(N-ethyl-N-i-amylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-phenyl, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindol-3-yl)-4,5,6,7-tetrachlorophthalide. Additional examples thereof include pyridine compounds, quinazoline compounds, and bisquinazoline compounds. These compounds may be used by mixing two or more of them.

The electron accepting color developing agent is an electron accepting compound which causes the color former compound to develop a color by interacting with the color former compound. Also the electron accepting color developing agent is an electron accepting compound which donates a proton to the electron donating color former compound such as a leuco dye.

Examples of the electron accepting color developing agent include phenols, metal salts of phenols, metal salts of carboxylic acids, aromatic carboxylic acids, aliphatic carboxylic acids having 2 to 5 carbon atoms, benzophenones, sulfonic acids, sulfonates, phosphoric acids, metal salts of phosphoric acids, acidic phosphoric acid esters, metal salts of acidic phosphoric acid esters, phosphorous acids, metal salts of phosphorous acids, monophenols, polyphenols, 1,2,3-triazole, and derivatives thereof.

The binder resin is melted by a fixing treatment and fixes a coloring material on a sheet.

As the binder resin, a polyester resin obtained by subjecting a dicarboxylic acid component and a diol component to an esterification reaction, followed by polycondensation is used. A styrene resin generally has a higher glass transition point than a polyester resin and therefore is disadvantageous from the viewpoint of low-temperature fixing.

Examples of the dicarboxylic acid component include aromatic dicarboxylic acids such as terephthalic acid, phthalic acid, and isophthalic acid; and aliphatic carboxylic acids such as fumaric acid, maleic acid, succinic acid, adipic acid, sebacic acid, glutaric acid, pimelic acid, oxalic acid, malonic acid, citraconic acid, and itaconic acid.

Examples of the alcohol component (diol component) include aliphatic diols such as ethylene glycol, propylene glycol, 1,4-butanediol, 1,3-butanediol, 1,5-pentanediol, 1,6-hexanediol, neopentyl glycol, trimethylene glycol, trimethylolpropane, and pentaerythritol; and alicyclic diols such as 1,4-cyclohexanediol and 1,4-cyclohexanedimethanol. Additional examples thereof include ethylene oxide adducts or propylene oxide adducts of bisphenol A (such as bisphenol A alkylene oxide adducts).

Further, the above polyester component may be converted so as to have a crosslinking structure using a trivalent or higher polyvalent carboxylic acid component or a trihydric or higher polyhydric alcohol component such as 1,2,4-benzenetricarboxylic acid (trimellitic acid) or glycerin.

Further, as the binder resin, two or more types of polyester resins having different compositions may be mixed and used.

The polyester resin may be crystalline or noncrystalline. The glass transition point of the polyester resin is preferably 45° C. or higher and 70° C. or lower, more preferably 50° C. or higher and 65° C. or lower. If the glass transition point is lower than 45° C., the heat-resistant storage stability of the toner is deteriorated, and also a gloss derived from the resin after decolorization is noticeable, and therefore, it is not preferred. Meanwhile, if the glass transition point is higher than 70° C., the low-temperature fixability is deteriorated, and also the decolorizing property when heating is poor, and therefore, it is not preferred.

The weight average molecular weight Mw of the binder resin is preferably 6000 or more and 25000 or less. If the weight average molecular weight Mw is less than 6000, a gloss derived from the resin in a decolorized region is noticeable, and therefore, it is not preferred. Meanwhile, if the weight average molecular weight Mw exceeds 25000, the fixing temperature of the toner is generally higher than the decolorization temperature of an image, and the toner cannot be used as a decolorizable toner, and therefore, it is not preferred.

Incidentally, the weight average molecular weight Mw can be measured by GPC as described above.

In addition, it is preferred that the electron donating color former compound and the electron accepting color developing agent of the toner are microencapsulated as a color material. By the microencapsulation of these components, the components are rarely affected by the external environment, and the color development and decolorization can be freely controlled.

It is preferred that the resulting microcapsules serving as the color material further contain a temperature control agent. The temperature control agent controls the decolorization temperature. The temperature control agent is a substance having a large temperature difference between the melting point and the solidification point. When the temperature control agent is heated to a temperature not lower than the melting point of the temperature control agent, the color material can be decolorized. Further, when the solidification point of the temperature control agent is normal temperature or lower, the color material maintained in a decolorized state even at normal temperature can be formed.

Examples of the temperature control agent include an alcohol, an ester, a ketone, an ether, and an acid amide.

Particularly preferred is an ester. Specific examples thereof include an ester of a carboxylic acid containing a substituted aromatic ring, an ester of a carboxylic acid containing an unsubstituted aromatic ring with an aliphatic alcohol, an ester of a carboxylic acid containing a cyclohexyl group in the molecule, an ester of a fatty acid with an unsubstituted aromatic alcohol or a phenol, an ester of a fatty acid with a branched aliphatic alcohol, an ester of a dicarboxylic acid with an aromatic alcohol or a branched aliphatic alcohol, dibenzyl cinnamate, heptyl stearate, didecyl adipate, dilauryl adipate, dimyristyl adipate, dicetyl adipate, distearyl adipate, trilaurin, trimyristin, tristearin, dimyristin, and distearin. These may be used by mixing two or more of them.

Subsequently, the physical properties of the toner will be described.

The glass transition point (Tg) of the toner is preferably 35° C. or higher and 65° C. or lower. If the glass transition point (Tg) of the toner is lower than 35° C., the heat-resistant storage stability of the toner is deteriorated, and also a gloss derived from the toner when the toner is decolorized by heating is noticeable, and therefore, it is not preferred. Meanwhile, if the glass transition point (Tg) of the toner is higher than 65° C., the low-temperature fixability is deteriorated, and also the property of decolorization by heating is deteriorated.

The softening point (Tm) of the toner is preferably 80° C. or higher and 120° C. or lower. If the softening point (Tm) of the toner is lower than 80° C., the storage stability of the toner is deteriorated. Meanwhile, if the softening point (Tm) of the toner is higher than 120° C., the fixing temperature is increased, and therefore, it is not preferred from the viewpoint of energy saving.

The toluene insoluble content in the toner is preferably 10% by mass or more and 40% by mass or less. The toluene insoluble content is a numerical value indicating the degree of crosslinking of a resin contained in the toner. If the toluene insoluble content is more than 40% by mass, the fixing temperature of the toner is generally higher than the decolorization temperature at which the decolorizable toner is decolorized. Meanwhile, if the toluene insoluble content is less than 10% by mass, even when the decolorizable toner is heated to decolorize the toner, a gloss derived from the resin in the decolorized region is noticeable, and therefore, it is not preferred.

The acid value (AV value) of the toner is preferably 25 mgKOH/g or less. The acid value of the toner refers to the amount (mg) of potassium hydroxide required for neutralizing free fatty acids contained in 1 g of fat and oil. If the acid value of the toner exceeds 25 mgKOH/g, when the encapsulation of the color material is not sufficient, the toner functions as a color developing agent, and the color is redeveloped, and therefore, it is not preferred.

Further, the toner may contain a release agent, a charge control agent, or the like.

The release agent improves the releasing property from a fixing member when the toner is fixed on a sheet by heating or applying pressure. Examples of the release agent include aliphatic hydrocarbon waxes such as low molecular weight polyethylenes having a molecular weight of about 1000, low molecular weight polypropylenes having a molecular weight of about 1000, polyolefin copolymers, polyolefin wax, paraffin wax, and Fischer-Tropsch wax, and modified products thereof; vegetable waxes such as candelilla wax, carnauba wax, Japan wax, jojoba wax, and rice wax; animal waxes such as bees wax, lanolin, and whale wax; mineral waxes such as montan wax, ozokerite, and ceresin; fatty acid amides such as linoleic acid amide, oleic acid amide, and lauric acid amide; functional synthetic waxes; and silicone waxes.

In this embodiment, it is particularly preferred that the release agent has an ester bond composed of an alcohol component and a carboxylic acid component. Examples of the alcohol component include higher alcohols, and examples of the carboxylic acid component include saturated fatty acids having a linear alkyl group; unsaturated fatty acids such as monoenoic acid and polyenoic acid; and hydroxyl fatty acids. Further, as the carboxylic acid component, an unsaturated polyvalent carboxylic acid such as maleic acid, fumaric acid, citraconic acid, or itaconic acid may be used. Further, an anhydride thereof may also be used.

The softening point of the release agent is from 50° C. to 120° C., more preferably from 60° C. to 110° C. for enabling the fixing at a low temperature from the viewpoint of low energy or prevention of curling of a sheet.

The charge control agent controls a frictional charge quantity.

As the charge control agent, a metal-containing azo compound is used, and the metal element is preferably a complex or a complex salt of iron, cobalt, or chromium, or a mixture thereof. Further, as the charge control agent, a metal-containing salicylic acid derivative compound may also be used, and the metal element is preferably a complex or a complex salt of zirconium, zinc, chromium, or boron, or a mixture thereof.

Incidentally, in the toner, an external additive in addition to toner particles may be mixed.

The external additive adjusts the fluidity or chargeability of the toner. The external additive can be mixed in an amount of from 0.01 to 20% by mass of the total amount of the toner particles. The external additive comprises inorganic fine particles, and silica, titania, alumina, strontium titanate, tin oxide, and the like can be used alone or by mixing two or more of them. It is preferred that as the inorganic fine particles, those surface-treated with a hydrophobizing agent are used from the viewpoint of improvement of environmental stability. Further, other than such inorganic oxides, resin fine particles having a size of 1 μm or less may be added as the external additive for improving the cleaning property.

Subsequently, the process for producing the toner according to this embodiment will be described with reference to FIG. 1. FIG. 1 is a flow chart showing a flow of a process for producing a toner. First, a color material composed of a color former compound, a color developing agent, and a temperature control agent is heated and melted (Act 101). Then, the color material is microencapsulated by a coacervation method (Act 102). The microencapsulated color material, a binder resin dispersion liquid in which a binder resin is dispersed, and a release agent dispersion liquid in which a release agent is dispersed are aggregated using aluminum sulfate ($Al_2(SO_4)_3$), followed by fusing (Act 103). Then, the fused material is washed (Act 104) and dried (Act 105), whereby a toner is obtained.

Incidentally, the method for the microencapsulation of the color material is not limited to the coacervation method, and a method by polymer deposition, a method using an isocyanate polyol wall material, a method using a urea-formaldehyde or urea-formaldehyde-resorcinol wall forming material, a method using a wall forming material such as a melamine-formaldehyde resin or hydroxypropyl cellulose, an in-situ method by monomer polymerization, an electrolytic dispersion cooling method, a spray-drying method, or the like may be used.

The toner according to this embodiment as described above develops a color by binding the color former compound such as a leuco dye to the color developing agent such as a phenolic compound. When the color former compound and the color developing agent are dissociated from each other, the color is erased. Further, the toner according to this embodiment decolorizes at a temperature not lower than the fixing temperature of the toner.

Subsequently, the toner according to this embodiment will be further described with reference to Examples.

First, processes for producing toners of respective Examples and Comparative Examples will be described.

Example 1

First, a finely pulverized binder resin and wax dispersion liquid was prepared by mixing 95 parts by weight of a polyester resin having a weight average molecular weight Mw of 6300 obtained by polycondensation of terephthalic acid and bisphenol A as a binder resin to be contained in a toner, 5 parts by weight of rice wax as a release agent, 1.0 parts by weight of Neogen R (manufactured by Dai-ichi Kogyo Seiyaku Co., Ltd.) as an anionic emulsifying agent, and 2.1 parts by weight of dimethylaminoethanol as a neutralizing agent using a high-pressure homogenizer.

Subsequently, a color material was prepared by mixing 10 parts by weight of crystal violet lactone (CVL) which is a leuco dye as a color former compound, 10 parts by weight of benzyl 4-hydroxybenzoate as a color developing agent, and 80 parts by weight of 4-benzyloxyphenylethyl laurate as a temperature control agent, and heating and melting the resulting mixture. Then, the color material was microencapsulated by a coacervation method.

Then, 10 parts by weight of the microencapsulated color material and 90 parts by weight of the finely pulverized binder resin and wax dispersion liquid were aggregated using aluminum sulfate ($Al_2(SO_4)_3$), followed by fusing. Then, the fused material was washed and dried, whereby toner particles were obtained. Subsequently, 3.5 wt % of hydrophobic silica ($SiO_2$) and 0.5 wt % of titanium oxide ($TiO_2$) were externally added and mixed with 100 parts by weight of the toner particles, whereby a toner of Example 1 was obtained.

Example 2

A finely pulverized binder resin and wax dispersion liquid was prepared in the same manner as in Example 1 except for changing the physical properties of the binder resin (weight average molecular weight Mw: 7500) and the release agent.

Also, a microencapsulated color material was prepared in the same manner as in Example 1. Then, toner particles were obtained by mixing the color material and the finely pulverized binder resin and wax dispersion liquid in the same manner as in Example 1, and the obtained toner particles were subjected to an external addition treatment in the same manner as in Example 1, whereby a toner of Example 2 was obtained.

Example 3

A finely pulverized binder resin and wax dispersion liquid was prepared in the same manner as in Example 1 except for changing the physical properties of the binder resin (weight average molecular weight Mw: 14000) and the release agent. Also, a microencapsulated color material was prepared in the same manner as in Example 1. Then, toner particles were obtained by mixing the color material and the finely pulverized binder resin and wax dispersion liquid in the same manner as in Example 1, and the obtained toner particles were subjected to an external addition treatment in the same manner as in Example 1, whereby a toner of Example 3 was obtained.

Example 4

A finely pulverized binder resin and wax dispersion liquid was prepared in the same manner as in Example 1 except for changing the physical properties of the binder resin (weight average molecular weight Mw: 24000) and the release agent. Also, a microencapsulated color material was prepared in the same manner as in Example 1. Then, toner particles were obtained by mixing the color material and the finely pulverized binder resin and wax dispersion liquid in the same manner as in Example 1, and the obtained toner particles were subjected to an external addition treatment in the same manner as in Example 1, whereby a toner of Example 4 was obtained.

Example 5

A finely pulverized binder resin and wax dispersion liquid was prepared in the same manner as in Example 1 except for changing the physical properties of the binder resin (weight average molecular weight Mw: 10000) and the release agent. Also, a microencapsulated color material was prepared in the same manner as in Example 1. Then, toner particles were obtained by mixing the color material and the finely pulverized binder resin and wax dispersion liquid in the same manner as in Example 1, and the obtained toner particles were subjected to an external addition treatment in the same manner as in Example 1, whereby a toner of Example 5 was obtained.

Example 6

A finely pulverized binder resin and wax dispersion liquid was prepared in the same manner as in Example 1 except for changing the physical properties of the binder resin (weight average molecular weight Mw: 8000) and the release agent. Also, a microencapsulated color material was prepared in the same manner as in Example 1. Then, toner particles were obtained by mixing the color material and the finely pulverized binder resin and wax dispersion liquid in the same manner as in Example 1, and the obtained toner particles were subjected to an external addition treatment in the same manner as in Example 1, whereby a toner of Example 6 was obtained.

Comparative Example 1

A finely pulverized binder resin and wax dispersion liquid was prepared in the same manner as in Example 1 except for changing the physical properties of the binder resin (weight average molecular weight Mw: 5800) and the release agent. Also, a microencapsulated color material was prepared in the same manner as in Example 1. Then, toner particles were obtained by mixing the color material and the finely pulverized binder resin and wax dispersion liquid in the same manner as in Example 1, and the obtained toner particles were subjected to an external addition treatment in the same manner as in Example 1, whereby a toner of Comparative Example 1 was obtained.

Comparative Example 2

A finely pulverized binder resin and wax dispersion liquid was prepared in the same manner as in Example 1 except for changing the physical properties of the binder resin (weight average molecular weight Mw: 27000) and the release agent. Also, a microencapsulated color material was prepared in the same manner as in Example 1. Then, the color material and the finely pulverized binder resin and wax dispersion liquid were mixed in the same manner as in Example 1, whereby a toner of Comparative Example 2 was obtained.

For the toners of Examples 1 to 6 and Comparative Examples 1 and 2 described above, the weight average molecular weight Mw of the binder resin, the acid value, the glass transition point Tg (° C.), the softening point Tm (° C.), the toluene insoluble content (% by mass), the fixing temperature of the toner, the decolorization temperature at which the toner is decolorized, and the glossiness in the decolorized region are shown in FIG. 2.

The weight average molecular weight Mw was measured by the GPC method for each of the binder resins used in the respective Examples and Comparative Examples. In the measurement, an instrument manufactured by WATERS, Inc. was used. As the detector, a differential refractive index detector (RI) manufactured by WATERS, Inc. was used. As the eluent (mobile phase), tetrahydrofuran (THF) was used.

The acid value was determined by the amount (mg) of potassium hydroxide required for neutralizing all of the acid components in the wax according to Test Method for Neutralization of Petroleum Products and Lubricants stipulated in Japanese Industrial Standards JIS K 2501-2003.

The glass transition point (Tg) was measured using a differential scanning calorimeter (DSC) manufactured by TA Instruments, Inc.

The softening point (Tm) was measured using a flow tester (CFT-500D) manufactured by Shimadzu Corporation.

The toluene insoluble content was determined by measuring the insoluble content after each of the toners of Examples and Comparative Examples was immersed in toluene for 2 hours, and was expressed in % by mass.

The glossiness in a region where the toner was decolorized is a value obtained by forming an image on a sheet using each of the toners of Examples and Comparative Examples, heating the formed image to decolorize the image, and then, measuring the glossiness in the decolorized region. The measurement was performed using a glossmeter (VG-2000) manufactured by Nippon Denshoku Industries Co., Ltd.

according to Test Method for Specular Glossiness (JIS Z 8741) at an incident and reflection angle of 60°.

When discussing the physical properties of the toners of Examples and Comparative Examples described above, the values for the toners of Examples fall within favorable ranges with respect to all evaluation items, and also the glossiness after decolorization was low.

Incidentally, the toner of Example 6 had an acid value of more than 25 mgKOH/g and a toluene insoluble content of less than 5% by mass. The glossiness in the decolorized region was not high, but the color of the toner remained in the decolorized region.

On the other hand, as for Comparative Examples, the toner of Comparative Example 1 had a weight average molecular weight of less than 6000, a softening point of lower than 80° C., and a toluene insoluble content of less than 5% by mass, and therefore, a gloss derived from the resin in the decolorized region was noticeable.

Further, the toner of Comparative Example 2 had a weight average molecular weight of more than 25000 and a fixing temperature as high as 120° C., and therefore, when the toner was heated to the fixing temperature, the toner was decolorized. Accordingly, the toner is not preferred because it cannot be used as a decolorizable toner.

As described above, according to this embodiment, a toner having excellent low-temperature fixability and giving a gloss which is not noticeable after decolorization can be produced.

Second Embodiment

A second embodiment will be described. A toner according to this embodiment is different from the toner according to the first embodiment in that the toner according to this embodiment further contains inorganic fine particles having a specific average primary particle diameter.

This embodiment is based on the finding that a gloss can be further suppressed by subjecting the toner according to the first embodiment to a specific external addition treatment.

Specifically, the toner according to the second embodiment contains a color material composed of a color former compound such as a leuco dye and a color developing agent, a binder resin, and further inorganic fine particles of at least one kind of substance having an average primary particle diameter of 50 nm or more and 200 nm or less. Further, the coverage of the toner with the inorganic fine particles having an average primary particle diameter of 50 nm or more and 200 nm or less is or less per fine particles of one kind of substance, and the coverage of the toner with all of the inorganic fine particles contained in the toner, regardless of the average primary particle diameter, is 50% or more and 150% or less.

For example, when two kinds of substances: silica and titania are used as fine particles, the coverage with silica fine particles having an average primary particle diameter of from 50 to 200 nm and the coverage with titania fine particles having an average primary particle diameter of from 50 to 200 nm are 30% or less, respectively. Further, as for the coverage with all of the inorganic fine particles, the coverage with all of the silica and titania fine particles is 50% or more and 150% or less, which is a value obtained without considering the particle diameter or the kind of substance.

Here, the "average primary particle diameter" refers to a "number average particle diameter". The number average particle diameter is determined by measuring the particle diameters (the average of the major and minor axis lengths) of 100 particles using a scanning electron microscope at an appropriate magnification in the range from 5000× to 50000×, and the average of the measured particle diameters is used as the average primary particle diameter.

Further, the "coverage" as used herein is defined by the following calculation formula.

Coverage=(volume average particle diameter of toner particles/average primary particle diameter of inorganic fine particles)×(absolute specific gravity of toner particles/absolute specific gravity of inorganic fine particles)×(weight of inorganic fine particles/weight of toner)×100

In the formula, the "volume average particle diameter" refers to 50% volume average particle diameter determined using a coulter counter Multisizer 3 manufactured by Beckman Coulter, Inc.

By adding such inorganic fine particles having a specific particle diameter such that the coverage of the toner with the inorganic fine particles is a specific value, light scattering is caused due to the inorganic fine particles of the toner fixed on a sheet, and therefore, a gloss can be suppressed. Accordingly, a gloss in a region where the toner was decolorized, can be made more unnoticeable.

Here the "light scattering" is called Mie scattering among light scattering forms. When the size of inorganic fine particles is approximately equal to the wavelength of light (when the size is larger than one-tenth of the wavelength), the visible light is scattered by the fine particles and a gloss is suppressed.

Examples of the inorganic fine particles include silica, titania, alumina, strontium titanate, and tin oxide. As the inorganic fine particles, these can be used alone or by mixing two or more of them.

It is necessary that the average primary particle diameter of the inorganic fine particles for scattering light is 50 nm or more and 200 nm or less as described above. If the average primary particle diameter is less than 50 nm, a gloss cannot be effectively suppressed by the added inorganic fine particles. Meanwhile, if the average primary particle diameter is more than 200 nm, the fine particles are released from the toner or toner scattering occurs, and therefore, the printing durability is deteriorated. Here, the "toner scattering" refers to a phenomenon in which the toner scatters in a region of a photoconductor where the toner should not be adhered or around the photoconductor during development and so on, resulting in making the inside and the outside of the machine dirty.

The amount of the inorganic fine particles to be mixed with the toner is preferably such that the coverage with the fine particles having an average primary particle diameter of 50 nm or more and 200 nm or less is 30% or less per fine particles of one kind of substance as described above. If the coverage exceeds 30%, the fine particles are released from the toner or toner scattering occurs, and therefore, the printing durability is deteriorated. Incidentally, it is more preferred that the coverage with the fine particles having an average primary particle diameter of 50 nm or more and 200 nm or less is 10% or more per fine particles of one kind of substance from the viewpoint of reduction in glossiness. Further, it is preferred that the coverage with all of the fine particles contained in the toner is 50% or more and 150% or less as described above. If the coverage is less than 50%, the fluidity or resistance to environmental change required as an external additive for a toner cannot be ensured, and therefore, the storage stability is deteriorated, and as a result, the printing durability is deteriorated. Meanwhile, if the coverage exceeds 150%, the percentage of the released fine particles in the toner is increased, and therefore, the charge amount of the toner is decreased, and as a result, the printing durability is deteriorated.

Incidentally, the "storage stability" refers to a property in which the toner particles are prevented from aggregating while storing the toner and the toner can be stably stored in a state where the fluidity is maintained.

Further, the "printing durability" refers to image stability for repeated printing and also includes fogging and toner scattering.

Further, the toner preferably has a glass transition point Tg of 30° C. or higher and 65° C. or lower. If the glass transition point Tg is lower than 30° C., when the toner fixed on a sheet is decolorized, a gloss in the decolorized region is noticeable, and therefore, it is not preferred. However, the toner according to this embodiment contains inorganic fine particles that suppress a gloss by scattering light, and therefore, the lower limit of the glass transition point can be set to 30° C. which is lower than the preferred lower limit (35° C.) set in the first embodiment. The matter that the low-temperature fixability is deteriorated when the glass transition point Tg exceeds 65° C. is the same as in the first embodiment.

Subsequently, a process for producing the toner according to this embodiment will be described. A toner is produced by the production process described in the first embodiment, and then, the above-mentioned inorganic fine particles are added to the toner in a given amount. As described above, the addition amount thereof is such that the coverage of the toner with the inorganic fine particles having an average primary particle diameter of 50 nm or more and 200 nm or less is 30% or less per fine particles of one kind of substance, and the coverage of the toner with all of the inorganic fine particles contained in the toner, regardless of the average primary particle diameter, is from 50 to 150%.

As described above, with the use of the toner according to this embodiment, due to the fine particles covering the toner particles composed of the color material, the binder resin, and the like, light is scattered and a gloss is further suppressed. Therefore, when an image is formed with the toner and the image is decolorized, a gloss in the decolorized region is more unnoticeable.

Subsequently, the toner according to this embodiment will be further described with reference to Examples.

First, processes for producing toners of respective Examples will be described.

Example 7

A finely pulverized binder resin and wax dispersion liquid was prepared in the same manner as in Example 1 of the first embodiment except for changing the physical properties of the binder resin (weight average molecular weight Mw: 6300) and the release agent. Also, a microencapsulated color material was prepared in the same manner as in Example 1. Then, the color material and the finely pulverized binder resin and wax dispersion liquid were mixed in the same manner as in Example 1, whereby a toner was obtained.

With the obtained toner, 3 parts by weight of inorganic fine particles of hydrophobic silica having an average primary particle diameter of 40 nm and 2 parts by weight of inorganic fine particles of hydrophobic silica having an average primary particle diameter of 100 nm were mixed by stirring, whereby a toner of Example 7 was obtained.

Example 8

A finely pulverized binder resin and wax dispersion liquid was prepared in the same manner as in Example 1 of the first embodiment except for changing the physical properties of the binder resin (weight average molecular weight Mw: 6300) and the release agent. Also, a microencapsulated color material was prepared in the same manner as in Example 1. Then, the color material and the finely pulverized binder resin and wax dispersion liquid were mixed in the same manner as in Example 1, whereby a toner was obtained.

With the obtained toner, 3 parts by weight of inorganic fine particles of hydrophobic silica having an average primary particle diameter of 40 nm and 2 parts by weight of inorganic fine particles of hydrophobic silica having an average primary particle diameter of 100 nm were mixed by stirring, whereby a toner of Example 8 was obtained.

Example 9

A finely pulverized binder resin and wax dispersion liquid was prepared in the same manner as in Example 1 of the first embodiment except for changing the physical properties of the binder resin (weight average molecular weight Mw: 6300) and the release agent. Also, a microencapsulated color material was prepared in the same manner as in Example 1. Then, the color material and the finely pulverized binder resin and wax dispersion liquid were mixed in the same manner as in Example 1, whereby a toner was obtained.

With the obtained toner, 2 parts by weight of inorganic fine particles of hydrophobic silica having an average primary particle diameter of 40 nm and 1.2 parts by weight of inorganic fine particles of hydrophobic silica having an average primary particle diameter of 100 nm were mixed by stirring, whereby a toner of Example 9 was obtained.

Example 10

A finely pulverized binder resin and wax dispersion liquid was prepared in the same manner as in Example 1 of the first embodiment except for changing the physical properties of the binder resin (weight average molecular weight Mw: 6300) and the release agent. Also, a microencapsulated color material was prepared in the same manner as in Example 1. Then, the color material and the finely pulverized binder resin and wax dispersion liquid were mixed in the same manner as in Example 1, whereby a toner was obtained.

With the obtained toner, 2 parts by weight of inorganic fine particles of hydrophobic silica having an average primary particle diameter of 15 nm were mixed by stirring, whereby a toner of Example 10 was obtained.

Example 11

A finely pulverized binder resin and wax dispersion liquid was prepared in the same manner as in Example 1 of the first embodiment except for changing the physical properties of the binder resin (weight average molecular weight Mw: 6300) and the release agent. Also, a microencapsulated color material was prepared in the same manner as in Example 1. Then, the color material and the finely pulverized binder resin and wax dispersion liquid were mixed in the same manner as in Example 1, whereby a toner was obtained.

With the obtained toner, 12 parts by weight of inorganic fine particles of hydrophobic silica having an average primary particle diameter of 230 nm were mixed by stirring, whereby a toner of Example 11 was obtained.

Example 12

A finely pulverized binder resin and wax dispersion liquid was prepared in the same manner as in Example 1 of the first embodiment except for changing the physical properties of the binder resin (weight average molecular weight Mw: 6300) and the release agent. Also, a microencapsulated color material was prepared in the same manner as in Example 1. Then, the color material and the finely pulverized binder resin and wax dispersion liquid were mixed in the same manner as in Example 1, whereby a toner was obtained.

With the obtained toner, 5.5 parts by weight of inorganic fine particles of hydrophobic silica having an average primary particle diameter of 100 nm were mixed by stirring, whereby a toner of Example 12 was obtained.

Example 13

A finely pulverized binder resin and wax dispersion liquid was prepared in the same manner as in Example 1 of the first embodiment except for changing the physical properties of the binder resin (weight average molecular weight Mw: 6300) and the release agent. Also, a microencapsulated color material was prepared in the same manner as in Example 1. Then, the color material and the finely pulverized binder resin and wax dispersion liquid were mixed in the same manner as in Example 1, whereby a toner was obtained.

With the obtained toner, 1.2 parts by weight of inorganic fine particles of hydrophobic silica having an average primary particle diameter of 40 nm and 1.2 parts by weight of inorganic fine particles of hydrophobic silica having an average primary particle diameter of 100 nm were mixed by stirring, whereby a toner of Example 13 was obtained.

Example 14

A finely pulverized binder resin and wax dispersion liquid was prepared in the same manner as in Example 1 of the first embodiment except for changing the physical properties of the binder resin (weight average molecular weight Mw: 6300) and the release agent. Also, a microencapsulated color material was prepared in the same manner as in Example 1. Then, the color material and the finely pulverized binder resin and wax dispersion liquid were mixed in the same manner as in Example 1, whereby a toner was obtained.

With the obtained toner, 3.5 parts by weight of inorganic fine particles of hydrophobic silica having an average primary particle diameter of 22 nm and 2 parts by weight of inorganic fine particles of hydrophobic silica having an average primary particle diameter of 100 nm were mixed by stirring, whereby a toner of Example 14 was obtained.

A table showing the glass transition point Tg (° C.), the number of types of fine particles, the average primary particle diameter of the fine particles (nm), the coverage with the fine particles having an average primary particle diameter of from 50 to 200 nm alone, the coverage with all of the fine particles, the storage stability, the glossiness after decolorization, the low-temperature fixability, and the printing durability for the toners of Examples 7 to 14 described above is shown in FIG. 3.

The storage stability was evaluated as follows. 20 g of the obtained toner of Example was weighed in a container, and the container was immersed in a constant temperature water tank at 50° C. for 8 hours. Then, by using a powder tester (manufactured by Hosokawa Micron Corporation), the container containing the toner was tapped three times, and thereafter, the toner was poured onto a 42-mesh sieve. Then, the sieve was vibrated by a powder tester (manufactured by Hosokawa Micron Corporation) for 10 seconds, and the amount of the toner remaining on the sieve was measured and evaluated in three grades: A: extremely good; B: good; and C: problematic.

The glossiness of the toner after decolorization was determined as follows. An image was formed on a sheet with the obtained toner using a multifunction peripheral (MFP) manufactured by Toshiba Tec Corporation, and the sheet having the image formed thereon was conveyed to a fixing device in which the fixing temperature was set to 150° C. at a paper feed rate of 200 mm/sec, whereby the image was decolorized. Then, the glossiness in the decolorized region was measured using a glossmeter manufactured by Nippon Denshoku Industries Co., Ltd.

In the toners of the respective Examples, the weight average molecular weight of the resin was 6300, which is in the preferred range of the weight average molecular weight described in the first embodiment, and therefore, the toners were generally favorable for glossiness, however, there was a difference in the level of the glossiness. Therefore, based on the glossiness of the toner of Example 1 described in the first embodiment, the glossiness was evaluated in three grades: A: extremely good; B: good; and C: moderate (equal to that of Example 1).

The printing durability was evaluated as follows. The obtained toner of Example was mixed with a carrier at a given ratio, the resulting mixture was placed in a MFP (e-STUDIO 4520) manufactured by Toshiba Tec Corporation modified for evaluation, and then, a paper feed test in which 10000 sheets of paper were fed through the MFP was performed. Then, the printing durability was evaluated comprehensively based on the results of evaluation for the charge amount of the toner after the paper feed test, fogging when the image was output, and toner scattering in the inside of the machine. The printing durability was evaluated also in three grades (A: extremely good; B: good; and C: problematic) in the same manner as the storage stability.

The toner of Example 7 was obtained by mixing two types of fine particles and satisfied the above-mentioned conditions for all of the items of the glass transition point Tg, the average primary particle diameter of the fine particles, and the coverage. Further, the evaluation of the toner for the storage stability, the glossiness in the decolorized region, the low-temperature fixability, and the printing durability was also favorable.

The toner of Example 8 had a glass transition point Tg of 25° C., which is lower than 30° C., and the low-temperature fixability was good, but the storage stability was not sufficient due to the too low Tg. Therefore, the effect on reduction in glossiness was not so obtained. Further, in the test for the printing durability, since the Tg was low, the fine particles were embedded in the toner, and therefore, the charge amount was decreased, fogging and toner scattering occurred, and thus, the evaluation for the printing durability was not favorable.

Meanwhile, the toner of Example 9 had a glass transition point Tg of 65° C., which is high, and therefore, although the evaluation for the storage stability and the glossiness was favorable, but the low-temperature fixability was not sufficient.

The toner of Example 10 was obtained by adding one type of fine particles, and the average primary particle diameter of the fine particles was 15 nm, which is smaller than 50 nm. Therefore, the coverage with the fine particles having an average primary particle diameter of from 50 to 200 nm was 0%. As a result, the effect on reduction in glossiness was not so obtained.

In the toner of Example 11, the average primary particle diameter of the fine particles was 230 nm, which exceeds 200 nm. Since the average primary particle diameter of the fine particles was too large, the adhesion force of the external additive to the toner was low, and the external additive was detached from the toner, and therefore, the charge amount was decreased, fogging and toner scattering occurred, and thus, the evaluation for the printing durability was low.

In the toner of Example 12, the coverage with the fine particles having an average primary particle diameter of from 50 to 200 nm was 56%, which exceeds 30%. Therefore, the external additive was liable to be released from the toner, and the toner from which the external additive was detached scattered and so on, and thus, the printing durability was deteriorated.

In the toner of Example 13, the coverage with all of the fine particles was 45%, which is lower than 50%. Therefore, the fluidity or resistance to environmental change required as an external additive for a toner could not be ensured, and thus, the evaluation for the storage stability and the printing durability was not favorable.

In the toner of Example 14, the coverage with all of the fine particles was 180%, which exceeds 150%. Therefore, the toner from which the external additive was detached scattered and so on, and thus, the printing durability was not favorable.

As described above, the toner of Example 7 which satisfies all of the conditions described in this embodiment has excellent storage stability, low-temperature fixability, and printing durability, and also a gloss after decolorization is further unnoticeable, and therefore is the best among the toner of Examples.

Third Embodiment

A third embodiment will be described. An electrophotographic toner according to this embodiment is a so-called decolorizable toner which is decolorized by heating.

The toner according to this embodiment contains at least an electron donating color developable agent (an electron donating color former compound), an electron accepting color developing agent, and a binder resin.

The electron donating color developable agent is a dye precursor compound to be used for displaying characters, figures, etc. As the electron donating color developable agent, a leuco dye can be mainly used. The leuco dye is an electron donating compound capable of developing a color by the action of a color developing agent, and examples thereof include diphenylmethane phthalides, phenylindolyl phthalides, indolyl phthalides, diphenylmethane azaphthalides, phenylindolyl azaphthalides, fluorans, styrynoquinolines, and diaza-rhodamine lactones.

Specific examples thereof include 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl)quinoline, spiro[5H-(1)benzopyrano(2,3-d)pyrimidine-5,1'(3'H)isobenzofuran]-3'-one, 2-(diethylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-methyl-, spiro[5H-(1)benzopyrano(2,3-d)pyrimidine-5,1'(3'H)isobenzofuran]-3'-one, 2-(di-n-butylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(N-ethyl-N-i-amylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-phenyl, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindol-3-yl)-4,5,6,7-tetrachlorophthalide. Additional examples thereof include pyridine compounds, quinazoline compounds, and bisquinazoline compounds. These compounds may be used by mixing two or more of them.

The electron accepting color developing agent is an electron accepting compound which causes the color developable agent to develop a color by interacting with the color developable agent. Also the electron accepting color developing agent is an electron accepting compound which donates a proton to the electron donating color developable agent such as a leuco dye.

Examples of the electron accepting color developing agent include phenols, metal salts of phenols, metal salts of carboxylic acids, aromatic carboxylic acids, aliphatic carboxylic acids having 2 to 5 carbon atoms, benzophenones, sulfonic acids, sulfonates, phosphoric acids, metal salts of phosphoric acids, acidic phosphoric acid esters, metal salts of acidic phosphoric acid esters, phosphorous acids, metal salts of phosphorous acids, monophenols, polyphenols, 1,2,3-triazole, and derivatives thereof.

The binder resin is melted by a fixing treatment and fixes a coloring material on a sheet.

As the binder resin, a polyester resin obtained by subjecting a dicarboxylic acid component and a diol component to an esterification reaction, followed by polycondensation is preferably used. For example, when a styrene resin is used as the binder resin, a styrene resin generally has a higher glass transition point than a polyester resin and therefore is disadvantageous from the viewpoint of low-temperature fixing.

Examples of the dicarboxylic acid component include aromatic dicarboxylic acids such as terephthalic acid, phthalic acid, and isophthalic acid; and aliphatic carboxylic acids such as fumaric acid, maleic acid, succinic acid, adipic acid, sebacic acid, glutaric acid, pimelic acid, oxalic acid, malonic acid, citraconic acid, and itaconic acid.

Examples of the alcohol component (diol component) include aliphatic diols such as ethylene glycol, propylene glycol, 1,4-butanediol, 1,3-butanediol, 1,5-pentanediol, 1,6-hexanediol, neopentyl glycol, trimethylene glycol, trimethylolpropane, and pentaerythritol; and alicyclic diols such as 1,4-cyclohexanediol and 1,4-cyclohexanedimethanol. Additional examples thereof include ethylene oxide adducts or propylene oxide adducts of bisphenol A (such as bisphenol A alkylene oxide adducts).

Further, the binder resin according to this embodiment is a polyester resin having a crosslinked structure formed of a crosslinking component including at least either one of a trivalent or higher valent carboxylic acid and a trihydric or higher hydric alcohol.

The crosslinking component is not limited as long as the component is a trivalent or higher valent carboxylic acid or a trihydric or higher hydric alcohol, however, for example, as the trivalent or higher valent carboxylic acid, 1,2,4-benzenetricarboxylic acid (trimellitic acid) can be used. Further, as the trihydric or higher hydric alcohol, glycerin can be used.

By adding such a crosslinking component, a crosslinking reaction is carried out, and therefore, a polyester resin having a large molecular weight is formed. In such a case, a polymer which is hardly melted exists even if a heating is performed for decolorization. Therefore, as compared with a polymer having a low molecular weight, a smooth surface is unlikely to be obtained, and as a result, a gloss after decolorization is considered to be suppressed.

From the viewpoint of suppressing a gloss, as the crosslinking component, 1,2,4-benzenetricarboxylic acid is most preferred.

The crosslinking component is preferably contained in an amount of 3 wt % or more and 15 wt % or less of the total amount of the binder resin. If the amount thereof is 3 wt % or more, an effect of suppressing a gloss can be more reliably obtained. Further, if the amount thereof is 15 wt % or less, the fixing temperature is not too high, and therefore, the amount of 15 wt % or less is preferred from the viewpoint of low-temperature fixability.

Incidentally, as the binder resin, two or more types of polyester resins having different compositions may be mixed and used.

Further, the polyester resin may be crystalline or noncrystalline.

The glass transition point of the polyester resin is preferably 45° C. or higher and 70° C. or lower, more preferably 50° C. or higher and 65° C. or lower. If the glass transition point is lower than 45° C., the heat-resistant storage stability of the toner is deteriorated, and also a gloss after decolorization is noticeable, and therefore, it is not preferred. Meanwhile, if the glass transition point is higher than 70° C., the low-temperature fixability is deteriorated, and also the decolorizing property when heating is poor, and therefore, it is not preferred.

The weight average molecular weight Mw of the binder resin is preferably 6000 or more and 25000 or less. If the weight average molecular weight Mw is less than 6000, a gloss derived from the resin in a decolorized region is noticeable, and therefore, it is not preferred. Meanwhile, if the weight average molecular weight Mw exceeds 25000, the fixing temperature of the toner is generally higher than the decolorization temperature of an image, and the toner cannot be used as a decolorizable toner, and therefore, it is not preferred.

Incidentally, the weight average molecular weight Mw can be measured by GPC as described above.

In addition, it is preferred that the electron donating color developable agent and the electron accepting color developing agent of the toner are microencapsulated as a color material. By the microencapsulation of these components, the components are rarely affected by the external environment, and the color development and decolorization can be freely controlled.

It is preferred that the resulting microcapsules serving as the color material further contain a temperature control agent. The temperature control agent controls the decolorization temperature. The temperature control agent is a substance having a large temperature difference between the melting point and the solidification point. When the temperature control agent is heated to a temperature not lower than the melting point of the temperature control agent, the color material can be decolorized. Further, when the solidification point of the temperature control agent is normal temperature or lower, the color material maintained in a decolorized state even at normal temperature can be formed.

Examples of the temperature control agent include an alcohol, an ester, a ketone, an ether, and an acid amide.

As the temperature control agent, an ester is particularly preferred. Specific examples thereof include an ester of a carboxylic acid containing a substituted aromatic ring, an ester of a carboxylic acid containing an unsubstituted aromatic ring with an aliphatic alcohol, an ester of a carboxylic acid containing a cyclohexyl group in the molecule, an ester of a fatty acid with an unsubstituted aromatic alcohol or a phenol, an ester of a fatty acid with a branched aliphatic alcohol, an ester of a dicarboxylic acid with an aromatic alcohol or a branched aliphatic alcohol, dibenzyl cinnamate, heptyl stearate, didecyl adipate, dilauryl adipate, dimyristyl adipate, dicetyl adipate, distearyl adipate, trilaurin, trimyristin, tristearin, dimyristin, and distearin. These may be used by mixing two or more of them.

Subsequently, the physical properties of the toner will be described.

The glass transition point (Tg) of the toner is preferably 35° C. or higher and 65° C. or lower. If the glass transition point (Tg) of the toner is lower than 35° C., the heat-resistant storage stability of the toner is deteriorated, and also a gloss derived from the toner when the toner is decolorized by heating is noticeable, and therefore, it is not preferred. Meanwhile, if the glass transition point (Tg) of the toner is higher than 65° C., the low-temperature fixability is deteriorated, and also the property of decolorization by heating is deteriorated.

The softening point (Tm) of the toner is preferably 80° C. or higher and 120° C. or lower. If the softening point (Tm) of the toner is lower than 80° C., the storage stability of the toner is deteriorated. Meanwhile, if the softening point (Tm) of the toner is higher than 120° C., the fixing temperature is increased, and therefore, it is not preferred from the viewpoint of energy saving.

The toluene insoluble content in the toner is preferably 15% by mass or more and 40% by mass or less. The toluene insoluble content is a numerical value indicating the degree of crosslinking of a resin contained in the toner. If the toluene insoluble content is more than 40% by mass, the fixing temperature of the toner is generally higher than the decolorization temperature at which the decolorizable toner is decolorized. Meanwhile, if the toluene insoluble content is less than 15% by mass, even when the decolorizable toner is heated to decolorize the toner, a gloss derived from the resin in the decolorized region is noticeable, and therefore, it is not preferred.

Incidentally, the toner may further contain a release agent, a charge control agent, or the like.

The release agent improves the releasing property from a fixing member when the toner is fixed on a sheet by heating or applying pressure. Examples of the release agent include aliphatic hydrocarbon waxes such as low molecular weight polyethylenes having a molecular weight of about 1000, low molecular weight polypropylenes having a molecular weight of about 1000, polyolefin copolymers, polyolefin wax, paraffin wax, and Fischer-Tropsch wax, and modified products thereof; vegetable waxes such as candelilla wax, carnauba wax, Japan wax, jojoba wax, and rice wax; animal waxes such as bees wax, lanolin, and whale wax; mineral waxes such as montan wax, ozokerite, and ceresin; fatty acid amides such as linoleic acid amide, oleic acid amide, and lauric acid amide; functional synthetic waxes; and silicone waxes.

In this embodiment, it is particularly preferred that the release agent has an ester bond composed of an alcohol component and a carboxylic acid component. Examples of the alcohol component include higher alcohols, and examples of the carboxylic acid component include saturated fatty acids having a linear alkyl group; unsaturated fatty acids such as monoenoic acid and polyenoic acid; and hydroxyl fatty acids. Further, as the carboxylic acid component, an unsaturated polyvalent carboxylic acid such as maleic acid, fumaric acid, citraconic acid, or itaconic acid may be used. Further, an anhydride thereof may also be used.

The softening point of the release agent is from 50° C. to 120° C., more preferably from 60° C. to 110° C. for enabling the fixing at a low temperature from the viewpoint of low energy or prevention of curling of a sheet.

The charge control agent controls a frictional charge quantity.

As the charge control agent, a metal-containing azo compound is used, and the metal element is preferably a complex or a complex salt of iron, cobalt, or chromium, or a mixture thereof. Further, as the charge control agent, a metal-containing salicylic acid derivative compound may also be used, and the metal element is preferably a complex or a complex salt of zirconium, zinc, chromium, or boron, or a mixture thereof.

Incidentally, in the toner, an external additive in addition to toner particles may be further mixed.

The external additive adjusts the fluidity or chargeability of the toner. The external additive can be mixed in an amount of from 0.01 to 20% by mass of the total amount of the toner particles. The external additive comprises inorganic fine particles, and silica, titania, alumina, strontium titanate, tin oxide, and the like can be used alone or by mixing two or more of them. It is preferred that as the inorganic fine particles, those surface-treated with a hydrophobizing agent are used from the viewpoint of improvement of environmental stability. Further, other than such inorganic oxides, resin fine particles having a size of 1 μm or less may be added as the external additive for improving the cleaning property.

Subsequently, the process for producing the toner according to this embodiment will be described with reference to FIG. 1. FIG. 1 is a flow chart showing a flow of a process for producing a toner. First, a color material composed of a color developable agent, a color developing agent, and a temperature control agent is heated and melted (Act 101). Then, the color material is microencapsulated with use of polyurethane by a coacervation method (Act 102). The microencapsulated color material, a binder resin dispersion liquid in which a binder resin is dispersed, and a release agent dispersion liquid in which a release agent is dispersed are aggregated using aluminum sulfate ($Al_2(SO_4)_3$), followed by fusing (Act 103). Then, the fused material is washed (Act 104) and dried (Act 105), whereby a toner is obtained.

Incidentally, the method for the microencapsulation of the color material is not limited to the coacervation method, and a method by polymer deposition, a method using an isocyanate polyol wall material, a method using a urea-formaldehyde or urea-formaldehyde-resorcinol wall forming material, a method using a wall forming material such as a melamine-formaldehyde resin or hydroxypropyl cellulose, an in-situ method by monomer polymerization, an electrolytic dispersion cooling method, a spray-drying method, or the like may be used.

Further, the binder resin can also be prepared by polycondensation of a dicarboxylic acid component, a diol component, and in this embodiment, further a crosslinking component including at least either one of a polyvalent carboxylic acid and a polyhydric alcohol.

The toner according to this embodiment as described above develops a color by binding a leuco dye-based color developable agent typified by crystal violet lactone (CVL) to the color developing agent. Further, the toner according to this embodiment has a characteristic that when the color developable agent and the color developing agent are dissociated from each other, the color is erased. The toner according to this embodiment decolorizes at a temperature higher than the fixing temperature of the toner at which the color developable compound and the color developing agent are dissociated with each other. Accordingly, the toner is not decolorized at a fixing temperature, and the fixed toner can be decolorized by heating to a temperature higher than the fixing temperature.

A device for decolorizing the decolorizable toner according to this embodiment is not particularly limited as long as the device is capable of heating to a temperature not lower than the decolorization temperature. However, similar to a fixing device of an image forming apparatus, a decolorizing device which performs decolorization by heating paper when the paper is nipped and conveyed is preferred. As the decolorizing device, an exclusive device which has such a decolorizing mechanism may be used or a fixing device of an image forming apparatus which also has a decolorizing function may be used.

Subsequently, the toner according to this embodiment will be further described with reference to Examples.

First, processes for producing toners of respective Examples and Comparative Examples will be described.

Example 15

First, as a binder resin to be contained in a toner, a polyester resin having a weight average molecular weight Mw of 8200 was prepared by polycondensation of 34 parts by weight of terephthalic acid, 54 parts by weight of an ethylene oxide compound of bisphenol A, and 12 parts by weight of trimellitic acid. Then, a finely pulverized binder resin and wax dispersion liquid was prepared by mixing 95 parts by weight of the thus prepared polyester resin, 5 parts by weight of rice wax as a release agent, 1.0 parts by weight of Neogen® (manufactured by Dai-ichi Kogyo Seiyaku Co., Ltd.) as an anionic emulsifying agent, and 2.1 parts by weight of dimethylaminoethanol as a neutralizing agent using a high-pressure homogenizer.

Subsequently, a color material was prepared by mixing 10 parts by weight of crystal violet lactone (CVL) which is a leuco dye as a color developable agent, 10 parts by weight of benzyl 4-hydroxybenzoate as a color developing agent, and 80 parts by weight of 4-benzyloxyphenylethyl laurate as a temperature control agent, and heating and melting the resulting mixture. Then, the color material was microencapsulated by a coacervation method.

Then, 10 parts by weight of the microencapsulated color material and 90 parts by weight of the finely pulverized binder resin and wax dispersion liquid were aggregated using aluminum sulfate ($Al_2(SO_4)_3$), followed by fusing. Then, the fused material was washed and dried, whereby toner particles were obtained. Subsequently, 3.5 wt % of hydrophobic silica ($SiO_2$) and 0.5 wt % of titanium oxide ($TiO_2$) were externally added and mixed with 100 parts by weight of the toner particles, whereby a toner of Example 15 was obtained.

Example 16

A polyester resin having a weight average molecular weight Mw of 7500 was prepared by polycondensation of 32 parts by weight of terephthalic acid, 53 parts by weight of an ethylene oxide compound of bisphenol A, and 15 parts by weight of trimellitic acid in the same manner as in Example 15. Then, by using this polyester resin, a toner of Example 16 was prepared in the same manner as in Example 15.

Example 17

A toner of Example 17 was prepared in the same manner as in Example 15 except that a polyester resin having a weight average molecular weight Mw of 8500 was prepared by polycondensation of 36 parts by weight of terephthalic acid, 59 parts by weight of an ethylene oxide compound of bisphenol A, and 5 parts by weight of trimellitic acid in place of the polyester resin in Example 15, and carnauba wax was used as a release agent having different physical properties from those of the release agent in Example 15.

Comparative Example 3

A polyester resin having a weight average molecular weight Mw of 7500 was prepared by polycondensation of 39 parts by weight of terephthalic acid and 61 parts by weight of an ethylene oxide compound of bisphenol A in the same manner as in Example 15. Then, by using this polyester resin, a toner of Comparative Example 3 was prepared in the same manner as in Example 15.

Comparative Example 4

A toner of Comparative Example 4 was prepared in the same manner as in Example 15 except that a polyester resin having a weight average molecular weight Mw of 5800 was prepared by polycondensation of 39 parts by weight of terephthalic acid and 61 parts by weight of an ethylene oxide compound of bisphenol A in the same manner as in Example 15, and carnauba wax was used as a release agent having different physical properties from those of the release agent in Example 15.

Evaluation Tests for Toners

In order to evaluate the toners of Examples 15 to 17 and Comparative Examples 3 and 4 prepared above, the weight average molecular weight Mw of the binder resin, the content of trimellitic acid, the toluene gel content (toluene insoluble content) (% by mass), the fixing temperature of the toner, the decolorization temperature at which the toner is decolorized, and the glossiness in the decolorized region were measured for the respective Examples and Comparative Examples, and the results are shown in the table of FIG. 4.

Incidentally, the fixation was performed using a developer prepared by mixing each of the toners of Examples and Comparative Examples with a carrier in an image forming apparatus (e-STUDIO 3520C, manufactured by Toshiba Tec Corporation). At this time, a temperature at which fixation can be performed was measured and a fixing temperature was determined.

Further, the toner fixed was decolorized using a device obtained by modifying a fixing device (fixing roller: pressing roller type) of an image forming apparatus of the same type as above so that the device also functions as a decolorizing device.

The weight average molecular weight Mw was measured by the GPC method for each of the binder resins used in the respective Examples and Comparative Examples. In the measurement, an instrument manufactured by WATERS, Inc. was used. As the detector, a differential refractive index detector (RI) manufactured by WATERS, Inc. was used. As the eluent (mobile phase), tetrahydrofuran (THF) was used.

The toluene gel content (toluene insoluble content) was determined by measuring the insoluble content after each of the toners of Examples and Comparative Examples was immersed in toluene for 2 hours, and was expressed in % by mass.

The glossiness in a region where the toner was decolorized is a value obtained by forming an image on a sheet using each of the toners of Examples and Comparative Examples, heating the formed image to decolorize the image, and then, measuring the glossiness in the decolorized region. The measurement was performed using a glossmeter (VG-2000) manufactured by Nippon Denshoku Industries Co., Ltd. according to Test Method for Specular Glossiness (JIS Z 8741) at an incident and reflection angle of 60°.

When discussing the evaluation results (FIG. 4) of the toners of Examples and Comparative Examples described above, it was found that, the toners of Examples 15 and 16 showed a glossiness lower than 10 (about 5), and therefore, light in a decolorized region after decolorization was hardly reflected and the decolorized region was not noticeable. Further, the toner of Example 17 could suppress the glossiness relatively low due to the crosslinking component.

Further, a decolorizing time was within 1 second and decolorization could be achieved in a short time in the case of all Examples.

On the other hand, as for Comparative Examples, the toner of Comparative Example 3 having a weight average molecular weight of 7500 showed a glossiness of 12, which was higher than that of Examples, and a gloss in the decolorized region after decolorization was noticeable.

Further, the toner of Comparative Example 4 showed a high glossiness, and a gloss in the decolorized region after decolorization was noticeable.

Fourth Embodiment

A fourth embodiment is explained.

Figure 5:
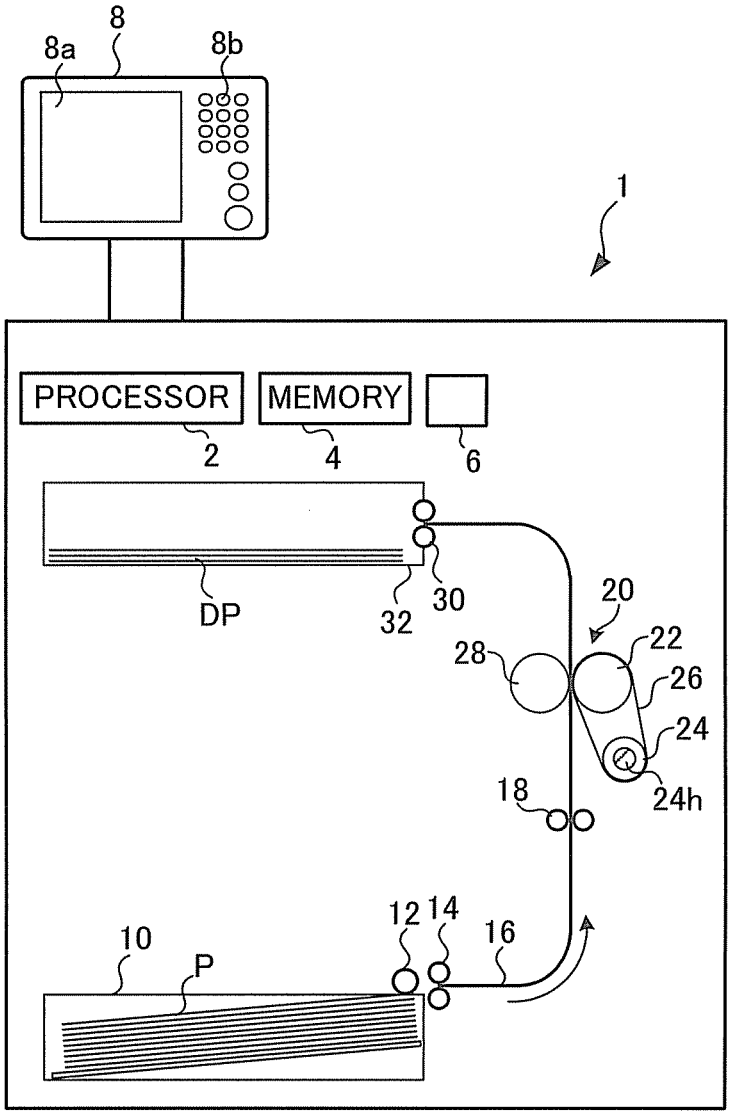
FIG. 5 is a diagram of the configuration of a decoloring apparatus according to an embodiment.

FIG. 5 is a diagram of the configuration of a decoloring apparatus 1 according to this embodiment.

The decoloring apparatus 1 applies, to a sheet on which an image is formed with a "decolorable colorant", which is a so-called decolorable toner, a decoloring process for erasing a color of the decolorable colorant.

The decoloring apparatus 1 includes a processor 2, a memory 4, an auxiliary storage device 6, an operation panel 8, a paper feeding cassette 10, a pickup roller 12, a decoloring section 20, and a discharge tray 32.

The processor 2 is a processing device configured to control the decoloring process in the decoloring apparatus 1. The processor 2 executes computer programs stored by the memory 4 and the auxiliary storage device 6 to thereby realize various functions and execute processes.

As the processor 2, for example, a CPU (Central Processing Unit) or an MPU (Micro Processing Unit) that can execute arithmetic processing equivalent to that of the CPU is used. As the processor 2, an ASIC (Application Specific Integrated Circuit) may be used. If the ASIC is used as the processor 2, the ASIC can realize a part or all of functions of the decoloring apparatus 1.

The memory 4 is a so-called main storage device. The memory 4 as the main storage device stores a computer program for the processor 2 to execute the decoloring process in the decoloring apparatus 1. The memory 4 provides the processor 2 with a temporary work area. As the memory 4, for example, a RAM (Random Access Memory), a ROM (Read Only Memory), a DRAM (Dynamic Random Access Memory), an SRAM (Static Random Access Memory), a VRAM (Video RAM), or a flash memory is used.

The auxiliary storage device 6 stores various kinds of information in the decoloring apparatus 1. The auxiliary storage device 6 may store the computer program stored by the memory 4. As the auxiliary storage device 6, for example, a magnetic storage device such as a hard disk drive, an optical storage device, a semiconductor storage device (a flash memory, etc.), or a combination of these storage devices is used.

The operation panel 8 includes a display section 8*a* of a touch panel type and various operation keys 8*b*. The display section 8*a* displays, for example, a setting screen for setting conditions for the decoloring process in the decoloring apparatus 1 and an operation state of the decoloring apparatus 1. The operation keys 8*b* include, for example, a ten key, a reset key, a stop key, and a start key. A user can perform, using the touch panel of the display section 8*a* or the operation keys 8*b*, operation input to the setting screen or the like displayed on the display section 8*a* and operation input for instructing execution of the decoloring process.

The paper feeding cassette 10 is a cassette configured to store sheets P to be subjected to the decoloring process by the decoloring apparatus 1.

The sheets P to be subjected to the decoloring process are sheets on which images are formed with a decolorable colorant such as a decolorable toner, a color of which is erased by heating. Since the color of the decolorable colorant on the surface of a sheet is erased by the decoloring process in the decoloring apparatus 1, reuse of the sheet is possible, for example, image formation can be performed on the sheet again.

Like a paper feeding cassette of a MFP (Multi Function Peripheral), the paper feeding cassette 10 may be configured to be drawn out to the outside of the apparatus to place sheets thereon.

The pickup roller 12 picks up sheets from the paper feeding cassette 10 one by one and feeds the sheet to a conveying path 16 through which the sheet is conveyed. The sheet fed to the conveying path 16 is conveyed to the decoloring section 20 by conveying roller pairs such as conveying rollers 14 and 18.

The decoloring section 20 heats the sheet and erases the color of the deplorable colorant fixed on the surface of the sheet. The decoloring section 20 includes a roller 22, a heating roller 24 serving as a heating rotating member, a heating belt 26, and a pressing roller 28 serving as a pressing member.

The roller 22 is a roller around which the heating belt 26 is wound and suspended. The roller 22 is arranged to be opposed to the pressing roller 28. The roller 22 applies, in cooperation with the pressing roller 28 opposed thereto, pressure to the sheet conveyed to the roller 22. As the roller 22, for example, a roller formed by providing a heat-resistant elastic layer made of silicon sponge on a cored bar can be used. As the heat-resistant elastic layer, a heat-resistant elastic layer not having very high hardness is desirable in order to secure a wide nip section.

The heating roller 24 is a roller around which the heating belt 26 is wound and suspended. The heating roller 24 heats the heating belt 26. The heating roller 24 includes a heater 24*h* that generates heat. The surface of the heating roller 24 is heated by the heater 24*h*. The heating belt 26 is heated by the heat of the heating roller 24. As the heating roller 24, a roller formed by coating a hollow cored bar of aluminum or iron with a film layer of PTFE (polytetrafluoroethylene) for wear prevention can be used. In order to further reduce warm-up time for the decoloring apparatus 1, as the heating roller 24, a roller having a low heat capacity such as a thin roller is desirable. As the heater 24*h*, for example, a halogen heater lamp can be used.

At least one of the roller 22 and the heating roller 24 is driven to rotate by a driving source such as a motor and rotates the heating belt 26.

The heating belt 26 is an endless belt that is wound and suspended around the roller 22 and the heating roller 24 to rotate and nips and conveys a sheet in cooperation with the pressing roller 28 opposed thereto. The heating belt 26 heats the sheet, which passes through a nip section between the heating belt 26 and the pressing roller 28, to temperature equal to or higher than decoloring temperature, at which the decolorable colorant is decolored, to erase the color of the decolorable colorant.

The heating belt 26 in this embodiment has a function of roughening the surface of the decolorable colorant to reduce a gloss of the decolorable colorant in addition to a function of erasing the color of the decolorable colorant on the sheet.

The color of the decolorable colorant can be erased by the decoloring process. However, the fixed colorant itself does not disappear. The colorant remains on the sheet even after the decoloring process. If the surface of the decolorable colorant fixed on the sheet is smooth, the decolorable colorant reflects light and is conspicuous even if the color is erased by the decoloring process. Therefore, the surface of the decolorable colorant is roughened.

Therefore, the heating belt 26 in this embodiment has, in order to roughen the surface of the decolorable colorant, scatter light, and reduce a gloss, very small unevenness on the surface that comes into contact with the sheet. Since the decolorable colorant fixed on the sheet is heated by the heating belt 26 having the very small unevenness, the color of the decolorable colorant fixed on the sheet is erased, the gloss is reduced, and the decolorable colorant is made less conspicuous after the decoloring process.

Figure 6:
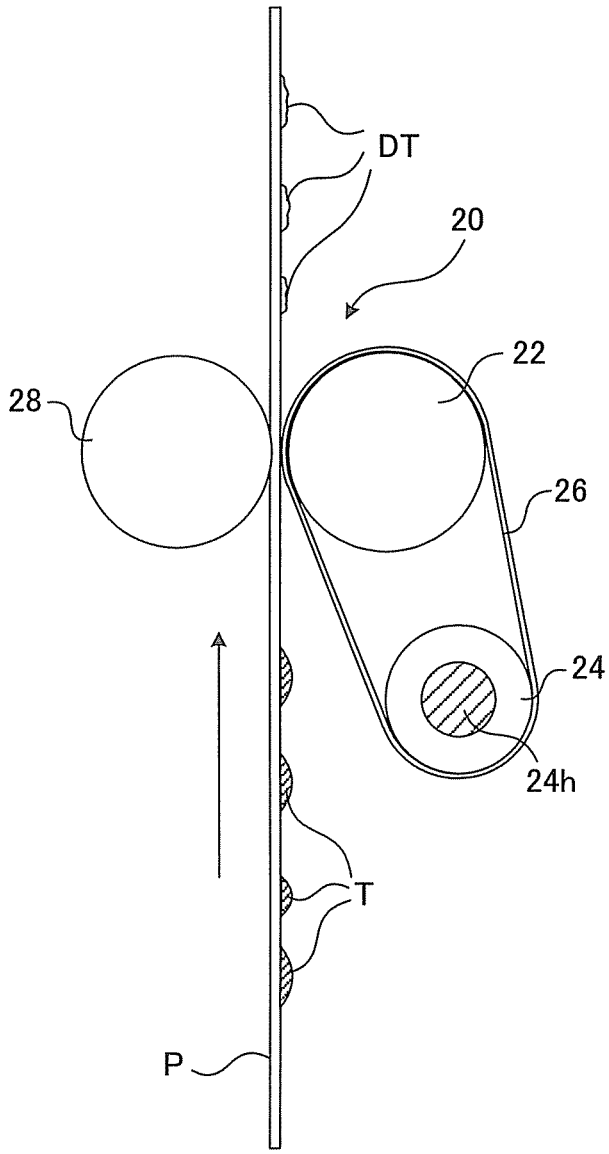
FIG. 6 is a schematic diagram of a decoloring section.

A schematic diagram of the decoloring section 20 is shown in FIG. 6.

The sheet P is nipped and conveyed by the heating belt 26 and the pressing roller 28. The surface to which a decolorable colorant T adheres is heated by the heating belt 26 and subjected to the decoloring process. Consequently, the decolorable colorant is decolored. Further, since the heating belt 26 has the very small unevenness on the surface as explained above, the surface of the decolorable colorant T is deformed in to an uneven shape by the heating belt 26 when the decolorable colorant T passes through the nip section. In FIG. 6, the decolorable colorant T after passing through the nip section is schematically shown as a decolorable colorant DT having the uneven surface. The decolorable colorant T is solid at the room temperature. However, when heated by the heating belt 26, the decolorable colorant T is softened and easily deformed by the unevenness on the surface of the heating belt 26.

In order to roughen the surface of the decolorable colorant T and reduce the gloss, the heating belt 26 desirably has an Rz value, which indicates the roughness of the surface of the heating belt 26, equal to or larger than 3.5 μm and equal to or smaller than 6.0 μm.

If the Rz value of the heating belt 26 is equal to or larger than 3.5 μm, the surface of the decolorable colorant T can be roughened to have a surface characteristic for scattering light and the gloss can be suppressed.

If the Rz value is equal to or smaller than 6.0 μm, it is possible to more surely prevent the decolorable colorant T from peeling from the surface of the sheet and adhering to the surface of the heating belt 26. If the Rz value exceeds 6.0 μm, in some cases, the decolorable colorant T on the sheet adheres to the heating belt 26 and a jam during sheet conveyance tends to occur.

As the heating belt 26, for example, a belt including, as a base material, an electrocast product containing nickel as a material, a stainless steel material, a polyimide material, or the like and having a heat resistant elastic layer of silicone rubber on the outer circumferential surface of the base material can be used.

The heating belt 26 may be a belt obtained by coating the outermost layer with fluorine resin having high releasability such as a PFA (fluorine resin) tube to improve releasability.

The roughness of the surface of the heating belt 26 can be adjusted to predetermined roughness by, for example, polishing the surface of the outermost layer of the heating belt 26 with a polishing material such as polishing paper.

The pressing roller 28 applies pressure to the sheet nipped and conveyed by the pressing roller 28 and the heating belt 26. The pressing roller 28 is brought into contact with and pressed against the heating belt 26 by a not-shown pressing mechanism. The pressing roller 28 is formed by coating a hollow cored bar of aluminum or iron with silicone rubber. The outer side of the silicone rubber layer may be coated with a PFA tube for improving releasability.

The pressing roller 28 may also include heating means such as a heater and heat the sheet in cooperation with the heating belt 26.

The pressing roller 28 is driven to rotate by a driving source such as a motor. Peeling means such as a peeling blade configured to peel the sheet may be arranged in the pressing roller 28.

The sheet having the reduced gloss and subjected to the decoloring process by the decoloring section 20 is conveyed by a conveying roller pair such as a conveying roller 30 and discharged to the discharge tray 32. Decolored sheets DP having the reduced gloss and subjected to the decoloring process are placed on the discharge tray 32. The discharge tray 32 may be able to be drawn out from the decoloring apparatus 1 to allow the sheets DP subjected to the decoloring process to be picked up. An opening communicating with the outside of the decoloring apparatus 1 may be provided to allow the sheets DP to be directly picked up from the discharge tray 32.

The configuration of the decoloring apparatus 1 according to this embodiment is as explained above.

With the decoloring apparatus 1 according to this embodiment, it is possible not only to erase the color of the decolorable colorant but also to reduce the gloss of the colorant to be decolored. Therefore, with the decoloring apparatus 1, it is possible to provide a recycle sheet on which a decolored portion is less conspicuous.

A decolorable colorant to be subjected to the decoloring process by the decoloring apparatus 1 according to this embodiment is explained below. The decolorable colorant explained below is an example. The decolorable colorant may be any colorant that is a decolorable colorant decolored by heat, contains resin, and keeps a gloss.

As the decolorable colorant, a decolorable colorant containing at least an electron-donating color assuming agent, an electron-accepting color developing agent, and binder resin (binding resin) can be used.

The electron-donating color assuming agent is a precursor compound of a coloring matter for displaying characters, figures, and the like. As the electron-donating color assuming agent, a leuco dye can be mainly used. The leuco dye is an electron-donating compound that can develop a color with a color developing agent. Examples of the leuco dye include diphenylmethane phthalide, phenylindolyl phthalide, indolyl phthalide, diphenylmethane azaphthalide, phenylindolyl azaphthalide, fluoran, styrynoquinoline, and diazarhodaminelactone.

The electron-accepting color developing agent is an electron-accepting compound that colors a color assuming agent according to a mutual action with the color assuming agent. The electron-accepting color developing agent is an electron-accepting compound that gives proton to the leuco dye, which is the electron-donating color assuming agent.

As the electron-accepting color developing agent, for example, phenol, phenol metallic salt, carboxylate metallic salt, aromatic carboxylate acid and aliphatic carboxylate acid having carbon number 2 to 5, benzophenone, sulfonic acid, sulfonate, phosphoric acid, phosphate metallic salt, acid phosphate, acid phosphate metallic salt, phosphorous acid, phosphorous acid metallic salt, monophenol, polyphenol, 1,2,3-triazole and derivative thereof are used.

The binder resin melts in a fixing process and fixes a coloring material on a sheet.

As the binder resin, polyester resin obtained by subjecting a dicarboxylic acid component and a diole component to condensation polymerization through an esterification reaction is used. Styrene resin is disadvantageous in terms of low-temperature fixing because, in general, glass transfer temperature is high compared with the polyester resin.

Examples of the dicarboxylic acid component include aromatic dicarboxylic acid such as terephthalic acid, phthalic acid, and isophhalic acid and aliphatic carboxylic acid such as fumaric acid, maleic acid, succinic acid, adipic acid, sebacic acid, glutaric acid, pimelic acid, oxalic acid, malonic acid, citraconic acid, and itaconic acid.

Examples of the alcohol component (the diole component) include aliphatic diole such as ethylene glycol, propylene glycol, 1,4-butanediole, 1,3-butanediole, 1,5-pentanediole, 1,6-hexandiole, neopentyl glycol, trimethylene glycol, trimethylolpropane, and pentaerythritol and alicyclic diole such as 1,4-cyclohexane diole and 1,4-cyclohexane dimethanol. Examples of the alcohol component also include ethylene oxide adduct or propylene oxide adduct such as bisphenol A (bisphenol A alkylene oxide adduct).

The polyester component may be formed in a crosslinking structure using trivalent or more multiple-valued carboxylic acid or multi-valued alcohol component such as 1,2,4-benzene tricarboxylic acid (trimellitic acid) or glycerin.

As the binder, two or more kinds of polyester resin having different compositions may be mixed and used.

An example of the decolorable colorant subjected to the decoloring process in the decoloring apparatus 1 according to this embodiment is as explained above. A sheet on which an image is formed with such a decolorable colorant can be subjected to the decoloring process with the reduced gloss by the decoloring apparatus 1 according to this embodiment.

In the embodiment explained above, the heating roller 24 configured to heat the heating belt 26 is heated by the heater 24*h*. However, heating means is not limited to this. The heating roller 24 can be heated by other heating means such as an IH coil. The heating belt 26 may be directly heated by an IH coil.

In the embodiment explained above, the heating roller 24 heats the heating belt 26. However, heating means is not limited to this. The roller 22 may be a heating roller including a heater. The roller 22 as the heating roller may heat the heating belt 26.

Fifth Embodiment

A fifth embodiment is explained below.

Figure 7:
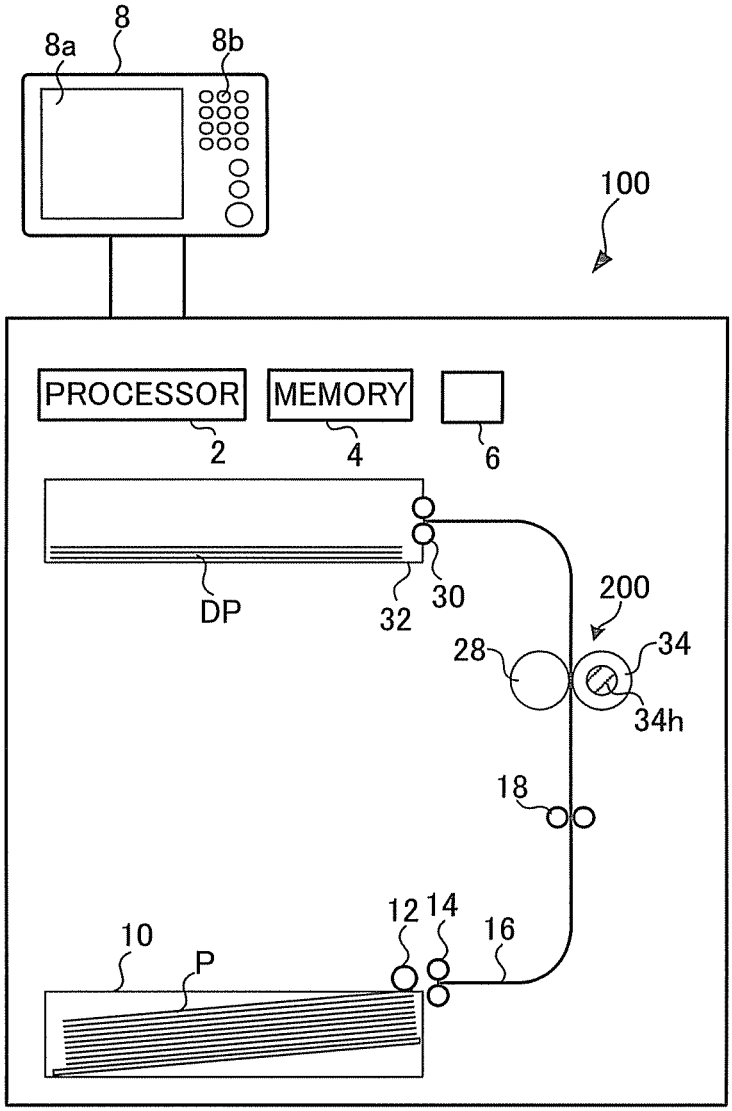
FIG. 7 is a diagram of the configuration of a decoloring apparatus according to an embodiment.

FIG. 7 is a diagram of the configuration of a decoloring apparatus 100 according to the fifth embodiment.

In the decoloring apparatus 100 according to the fifth embodiment, a decoloring section 200 has a configuration different from that of the decoloring section 20 in the fourth embodiment. Specifically, in the decoloring section 20 in the fourth embodiment, a sheet is heated and decolored by the heating belt 26. However, in the decoloring section 200 in this embodiment, a sheet is heated and decolored by a heating roller 34. The other components are the same as those of the decoloring apparatus 1 according to the fourth embodiment.

The heating roller 34 in this embodiment heats a sheet while nipping and conveying the sheet in cooperation with the pressing roller 28. The heating roller 34 heats the sheets at temperature equal to or higher than decoloring temperature of a decolorable colorant to erase a color of the decolorable colorant.

Like the heating belt 26 in the fourth embodiment, the heating roller 34 has, in order to roughen the surface of the decolorable colorant and reduce a gloss, very small unevenness on the surface that comes into contact with the sheet. Very small unevenness can be formed on the surface of the decolorable colorant by the very small unevenness to prevent light from being easily reflected and make the decolored decolorable colorant less conspicuous.

Like the heating belt 26 in the fourth embodiment, the heating roller 34 desirably has an Rz value, which indicates the roughness of the surface of the heating roller 34, equal to or larger than 3.5 μm and equal to or smaller than 6.0 μm. A reason for this is as explained in the fourth embodiment.

The heating roller 34 includes a heater **34*h* such as a halogen heater lamp. As the heating roller 34**, a roller formed by coating the surface of a hollow cored bar of aluminum or iron with a film layer of PTFE can be used. In this case, the surface of the film layer of PTFE is desirably adjusted to the roughness explained above.

When the heating roller 34 is the roller having the film layer of PTFE, first, the surface of the cored bar is coated with PTFE to form a PTFE film layer and the PTFE film layer is dried and cooled. Thereafter, the roller surface is burned in a burning furnace. After the burning, the roller surface is cooled. After the cooling, the surface of the heating roller 34 is polished by a polishing material such as polishing paper to adjust an Rz value of the roller surface to the predetermined range explained above. A method of manufacturing the heating roller 34 is as explained above.

Since the other components of the decoloring apparatus 100 are the same as those of the decoloring apparatus 1 according to the fourth embodiment, explanation of the components is omitted.

With the decoloring apparatus 100 according to this embodiment explained above, as in the fourth embodiment, it is possible to erase the color of the decolorable colorant while reducing the gloss of the surface of the decolorable colorant. Therefore, it is possible to provide a sheet subjected to the decoloring process on which the decolorable colorant after the decoloring process is less conspicuous.

Sixth Embodiment

A sixth embodiment is explained below.

Figure 8:
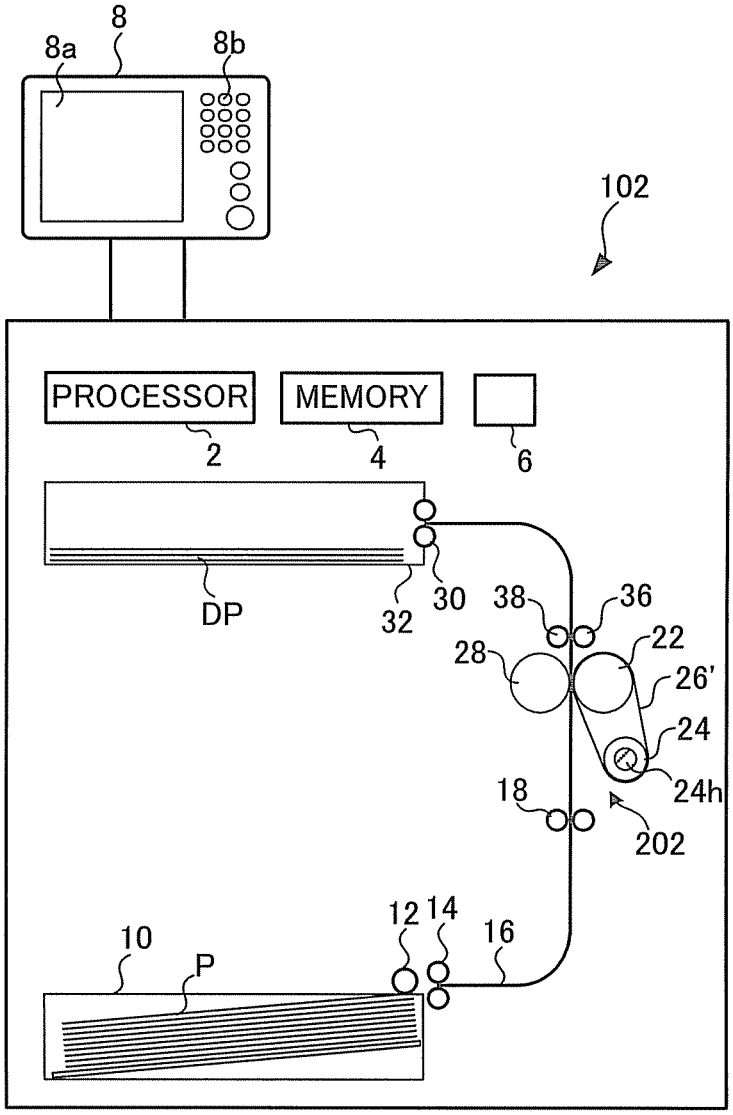
FIG. 8 is a diagram of the configuration of a decoloring apparatus according to an embodiment.

FIG. 8 is a diagram of the configuration of a decoloring apparatus 102 according to this embodiment.

The decoloring apparatus 102 according to this embodiment is different from the fourth and fifth embodiments in that a roller 36 arranged in a position on a downstream side in a sheet conveying direction with respect to the decoloring section 20 performs a process for roughening the surface of a decolorable colorant, which is a process for reducing a gloss of the surface of the decolorable colorant. The configuration of the decoloring apparatus 102 according to this embodiment is explained below.

The decoloring apparatus 102 includes a decoloring section 202, the roller 36, and an opposed roller 38 as components different from those of the decoloring apparatus 1 according to the fourth embodiment.

The decoloring section 202 includes the roller 22, the heating roller 24, a heating belt 26', and the pressing roller 28.

The roller 22, the heating roller 24, and the pressing roller 28 are the same as those in the fourth embodiment.

As in the fourth embodiment, the heating belt 26' heats a sheet and decolors the decolorable colorant fixed on the sheet. However, the heating belt 26' does not have very small unevenness on the surface and does not have a function for reducing the gloss of the decolorable colorant.

Instead of the heating belt 26 in the fourth embodiment and the heating roller 34 in the fifth embodiment, the roller 36 changes the surface of the decolorable colorant from a smooth state to a surface characteristic having very small unevenness and reduces the gloss of the decolorable colorant. Specifically, like the heating belt 26 in the fourth embodiment and the heating roller 34 in the fifth embodiment, the roller 36 has very small unevenness on the surface. Very small unevenness is formed on the surface of the decolorable colorant by the very small unevenness to scatter light and prevent the light from being easily reflected and make the decolored decolorable colorant less conspicuous.

Like the heating belt 26 in the fourth embodiment and the heating roller 36 in the fifth embodiment, the roller 36 desirably has an Rz value, which indicates the roughness of the surface of the roller 36, equal to or larger than 3.5 μm and equal to or smaller than 6.0 μm. A reason for this is as explained in the fourth embodiment.

The roller 36 is arranged further on a downstream side in a sheet conveying direction than a nip section of the decoloring section 202 together with the opposed roller 38. The roller 36 and the opposed roller 38 are desirably arranged in a position closer to the nip section of the decoloring section 202. This is because the sheet is desirably nipped and conveyed by the roller 36 and the opposed roller 38 while the temperature of the decolorable colorant heated by the heating belt 26' is higher and the decolorable colorant is easily deformed. This is because, if the temperature of the decolorable colorant falls, binder resin solidifies and hardens and, even if the very small unevenness on the surface of the roller 36 comes into contact with the decolorable colorant, the decolorable colorant is less easily deformed and, therefore, the effect of reducing the gloss by the roller 36 decreases.

The opposed roller 38 is arranged in a position opposed to the roller 36. The opposed roller 38 and the roller 36 come into contact with each other and nip and convey the sheet. Since the opposed roller 38 and the roller 36 are in contact with each other at predetermined pressure, the roller 36 comes into press contact with the sheet. The surface of the decolorable colorant can be changed from the smooth state to the surface characteristic having very small unevenness.

As explained above, with the decoloring apparatus 102 according to this embodiment, it is possible to erase the color of the decolorable colorant while reducing the gloss of the surface of the decolorable colorant. Therefore, it is possible to provide a recycle sheet on which the decolorable colorant after a decoloring process is not conspicuous.

In the embodiment explained above, the decoloring section 202 heats the sheet with the heating belt 26'. However, heating means is not limited to this. As in the fifth embodiment, the sheet may be heated by a heating roller rather than a belt system.

The roller 36 may be a rotating member of the belt system having very small unevenness on the surface of a belt.

Seventh Embodiment

A seventh embodiment is explained below.

Figure 9:
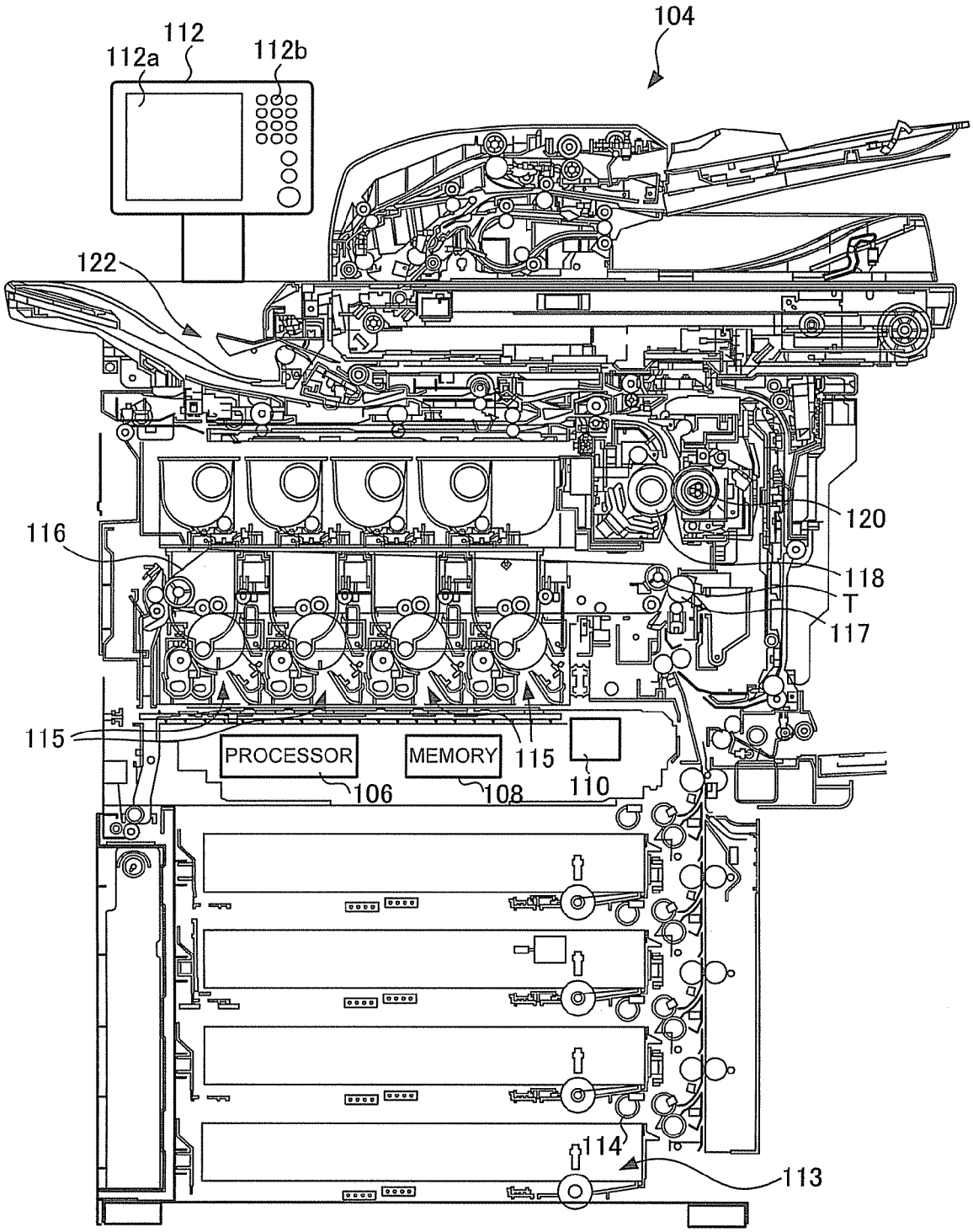
FIG. 9 is a diagram of the configuration of an image forming apparatus according to an embodiment.

FIG. 9 is a diagram of the configuration of an image forming apparatus 104 according to this embodiment.

The image forming apparatus 104 according to this embodiment performs, with a fixing section of the image forming apparatus, the decoloring process of the decoloring apparatus explained in the fourth to sixth embodiment. Specifically, the image forming apparatus 104 functions as the image forming apparatus in an operation state in which an image forming process is performed (hereinafter also referred to as image forming mode) and functions as a decoloring apparatus in an operation state in which the decoloring process is performed (hereinafter also referred to as decoloring process mode). The configuration of the image forming apparatus 104 according to this embodiment is explained below.

The image forming apparatus 104 is a so-called MFP (Multi Function Peripheral).

The image forming apparatus 104 according to this embodiment includes a processor 106, a memory 108, an auxiliary storage device 110, an operation panel 112, a paper feeding cassette 113, process units 115, an intermediate transfer belt 116, a fixing roller 118, a pressing roller 120, and a discharge tray 122.

The processor 106 is a processing device configured to control various processes in the image forming apparatus 104 such as the image forming process and an image reading process. In this embodiment, the processor 106 controls a decoloring process for erasing a color of a decolorable colorant fixed on a sheet. The processor 106 executes computer programs stored by the memory 108 and the auxiliary storage device 110 to thereby realize various functions and execute processes.

As the processor 106, for example, a CPU (Central Processing Unit) or an MPU (Micro Processing Unit) that can execute arithmetic processing equivalent to that of the CPU is used. As the processor 106, an ASIC (Application Specific Integrated Circuit) may be used. The ASIC can realize a part or all of functions of the image forming apparatus 104.

The memory 108 is a so-called main storage device. The memory 108 as the main storage device stores a computer program for the processor 106 to execute processes such as the image forming process, a sheet supplying process, and the image reading process. In this embodiment, the memory 108 also stores a computer program for the processor 106 to execute the decoloring process for erasing the color of the decolorable colorant fixed on the sheet. The memory 108 provides the processor 106 with a temporary work area. As the memory 108, for example, a RAM (Random Access Memory), a ROM (Read Only Memory), a DRAM (Dynamic Random Access Memory), an SRAM (Static Random Access Memory), a VRAM (Video RAM), or a flash memory is used.

The auxiliary storage device 110 stores various kinds of information in the image forming apparatus 104. The auxiliary storage device 110 may store the computer program stored by the memory 108. As the auxiliary storage device 110, for example, a magnetic storage device such as a hard disk drive, an optical storage device, a semiconductor storage device (a flash memory, etc.), or a combination of these storage devices is used.

The operation panel 112 includes a display section 112*a* of a touch panel type and various operation keys 112*b*. The display section 112*a* displays instruction items concerning printing conditions such as a sheet size, the number of copies, printing density setting, and finishing (stapling and folding). The operation keys 112*b* include, for example, a ten key, a reset key, a stop key, and a start key. A user can input instructions and operation concerning various processes and items displayed on the display section 112*a* from the touch panel of the display section 112*a* or the operation keys 112*b*. In this embodiment, the user can operate the operation panel 112 to designate the decoloring process mode and perform operation input for instructing the image forming apparatus 104 to execute the decoloring process.

The paper feeding cassette 113 stores sheets to be subjected to the decoloring process. A paper feeding cassette configured to store sheets to be subjected to the decoloring process is not limited to the paper feeding cassette 113 at the bottom shown in FIG. 9. Another paper feeding cassette may be used as the paper feeding cassette configured to store the sheets to be subjected to the decoloring process. The sheets to be subjected to the decoloring process may be supplied from a manual paper feeding section.

The process units 115 form developer images on photoconductive members and transfer the developer images onto the intermediate transfer belt 116. The image forming apparatus 104 includes four process units 115 respectively corresponding to four colors (e.g., yellow, magenta, cyan, and black). If the decolorable colorant is supplied to the process units 115 from respective toner cartridges, the process units 115 can also perform the image forming process using the decolorable colorant.

The intermediate transfer belt 116 secondarily transfers the developer images, which are primarily transferred from the photoconductive members of the process units 115, onto a sheet in a secondary transfer position T where a secondary transfer roller 117 is arranged.

If the decoloring process is performed, since the developer images are not transferred onto the sheet, the secondary transfer roller 117 and the intermediate transfer belt 116 may be spaced apart when the sheet passes.

In the image forming process mode, the fixing roller 118 comes into press contact with the pressing roller 120 opposed to the fixing roller 118 and fixes a colorant such as a toner, which is secondarily transferred on the sheet, on the sheet with heat and pressure. The fixing roller 118 is heated by heating means such as a heater and can perform a fixing process.

In the decoloring process mode in which the decoloring process is performed, the fixing roller 118 in this embodiment applies heat to the sheet on which the decolorable colorant is fixed and erases the color of the decolorable colorant. Usually, the color of the decolorable colorant disappears at temperature higher than fixing temperature. Therefore, in the decoloring process mode, the fixing roller 118 is heated to decoloring temperature set to temperature higher than the fixing temperature and performs the decoloring process. The fixing temperature and the decoloring temperature are different depending on a composition of a colorant. For example, in the decolorable colorant explained in the fourth embodiment, the fixing temperature is about 80° C. to 100° C. and the decoloring temperature is temperature higher than the fixing temperature and is about 100° C. to 150° C. A temperature control function for heating the fixing roller 118 to temperature necessary in each of the image forming mode and the decoloring process mode is realized by the processor 106 reading the computer program stored in the memory 108 or the like.

Like the heating belt 26 in the fourth embodiment, the heating roller 34 in the fifth embodiment, and the like, the fixing roller 118 in this embodiment has, in order to roughen the surface of the decolorable colorant and eliminate a gloss, very small unevenness on a surface that comes into contact with the sheet. Very small unevenness is formed on the surface of the decolorable colorant by the very small unevenness to prevent the light from being reflected and make the decolored decolorable colorant less conspicuous.

Like the heating belt 26 in the fourth embodiment and the like, the fixing roller 118 desirably has an Rz value, which indicates the roughness of the surface of the fixing roller 118, equal to or larger than 3.5 μm and equal to or smaller than 6.0 μm. A reason for this is as explained in the fourth embodiment.

The pressing roller 120 is a rubber roller for securing a nip amount between the pressing roller 120 and the fixing roller 118.

A sheet on which a toner is fixed by the fixing roller 118 and the pressing roller 120 or a sheet subjected to the decoloring process on which the color of the decolorable colorant is erased is discharged to the discharge tray 122.

With the image forming apparatus 104 according to this embodiment explained above, it is possible to perform, with the image forming apparatus that performs the image forming process, the decoloring process for erasing the color of the decolorable colorant while reducing the gloss of the surface of the decolorable colorant. Therefore, it is possible to provide a recycle sheet on which the decolorable colorant after the decoloring process is not conspicuous. In particular, in the case of this embodiment, the image forming apparatus 104 is convenient because the image forming apparatus 104 has the function of the decoloring apparatus.

In the embodiment explained above, the fixing roller 118 and the pressing roller 112 perform the decoloring process. However, means for performing the decoloring process is not limited to this. Like the heating belt 26 in the fourth embodiment, the image forming apparatus 104 may include a fixing belt of a belt system instead of the fixing roller 118.

EXAMPLES

The embodiments explained above are explained more in detail below with reference to examples. As the examples, decoloring apparatuses (decoloring dedicated apparatuses) or image forming apparatuses including rollers or belts having different levels of surface roughness was prepared. The decoloring process was applied to sheets, on which images are formed with the decoloring colorant, using the apparatuses of the examples and gloss levels in decolored sections were evaluated. It was also evaluated concerning the examples whether the decolorable colorant adhered to the rollers or the belts and whether a jam of a sheet occurred.

The examples and comparative examples for comparison are explained below.

Surface roughness of an area 0.35 $mm^2$ on the belts or the rollers was measured using a laser microscope (VK-9700) manufactured by Keyence Corporation and adopted as a roughness Rz value of the surfaces of the belts or the rollers having very small unevenness.

Example 18

An example 18 is the decoloring apparatus including the configuration of the fourth embodiment shown in FIG. 5. As the heating belt, a heating belt having a surface formed of an elastic layer of silicone rubber was used. The Rz value of the belt surface was 4.582 μm.

Example 19

An example 19 is the decoloring apparatus including the configuration of the fifth embodiment shown in FIG. 7.

The heating roller was formed by, after applying PTFE resin on the surface of a cored bar and burning the PTFE resin, polishing the surface with sandpaper. The roughness Rz value of the surface of the roller was 3.895 μm.

Example 20

An example 20 is the image forming apparatus including the configuration of the seventh embodiment shown in FIG. 9. However, the image forming apparatus performs the fixing and decoloring processes with the fixing belt system rather than the fixing roller system. The fixing belt was the same as that in the example 18. A fixing belt having a surface formed of an elastic layer of silicone rubber was used. The Rz value of the belt surface was 4.582 μm.

Example 21

An example 21 is the decoloring apparatus including the configuration of the fifth embodiment shown in FIG. 7 as in the example 19. A manufacturing method is the same as that in the example 19. However, the roughness Rz value of the surface of the roller was set to 5.651 μm.

Comparative Example 5

A comparative example 5 is a decoloring apparatus having a configuration same as that in the example 18. However, as the heating belt, a heating belt obtained by coating an elastic layer of silicone rubber with PFA (a copolymer of tetrafluoroethylene and perfluoroalkoxyethylene) was used. An Rz value was 3.152 μm.

Comparative Example 6

A comparative example 6 is a decoloring apparatus having a configuration same as that in the example 18. As the heating belt, a heating belt having a surface formed of an elastic layer of silicone rubber was used. An Rz value was 7.352 μm.

Preparation of a Decolorable Colorant and an Image Forming Process and a Decoloring Process Applied to a Sheet A decolorable colorant to be subjected to the decoloring process by the decoloring apparatuses or the image forming apparatuses in the examples was prepared as explained below.

First, polyester resin having weight average molecular weight Mw of 6300 obtained by subjecting terephthalic acid and bisphenor A to condensation polymerization, rice bran wax as a releasing agent, Neogen® (manufactured by Daiichi Kogyo Seiyaku Co., Ltd.) as an anionic emulsifier, a neutralizer dimethylaminoethanol were mixed at a ratio of 95 parts by weight, 5 parts by weight, 1.0 parts by weight, and 2.1 parts by weight, respectively, using a high-pressure homogenizer and generated as atomized fluid dispersion of a binder resin included in a toner.

Subsequently, as a color material, CVL (Crystal violet lactone) of a leuco dye as a color assuming agent, 4-hydroxybenzoic acid as a color developing agent, and lauric acid-4-benzyloxy phenylethyl as a temperature control agent were mixed at a ratio of 10 parts by weight, 10 parts by weight, and 80 parts by weight, respectively, and heated and fused. The color material was micro-encapsulated by a coacervation method.

10 parts by weight of the micro-encapsulated color material and 90 parts by weight of atomized fluid dispersion of the binder resin and wax were condensed and fused using aluminum sulfate ($Al_2(SO_4)_3$). A fused material was cleaned and dried to obtain toner particles. 3.5 weight % of hydrophobic silica ($SiO_2$) and 0.5 weight % of titanium oxide ($TiO_2$) were externally added and mixed with 100 parts by weight of the particles to obtain a decolorable toner (a decolorable colorant).

The decolorable toner was mixed with a carrier to prepare a two-component developer.

The image forming process was performed using a developer containing the decolorable colorant. As the image forming process, fixing and printing were performed at fixing temperature of 85° C. and fixing speed of 75 mm/s using remodeled e-STUDIO3520C manufactured by Toshiba Tec.

The decoloring process was performed by the decoloring apparatuses or the image forming apparatuses of the examples and the comparative examples. The decoloring process was performed by heating the heating belt (roller) or the fixing belt to 120° C., whereby a sheet was heated. Decoloring time (time in which the sheet is in contact with the decoloring means such as the heating belt) was 0.3 second.

Evaluation Test for Gloss Levels, Peeling of a Toner, and a Jam (1) Test Method

Gloss levels were measured concerning a sheet subjected to the decoloring process by the apparatuses of the examples and the comparative examples using the method explained above. The gloss levels were measured by a gloss meter (VG2000) manufactured by Nippon Denshoku Industries Co., Ltd. in conformity to a specular gloss measuring method (JISff Z 8741). The gloss levels were measured at a light projecting and receiving angle of 60 degrees.

Concerning the peeling of a toner and a jam, it was checked whether a toner adhered to the heating belt (roller) or the fixing belt and whether a jam occurred in the decoloring process in the apparatuses of the examples and the comparative examples.

(2) Test Results

Test results are shown in FIG. 10. In a table of FIG. 10, if the toner did not adhere, A is shown and, if the toner adhered, B is shown. In the table of FIG. 10, if a jam did not occur, A is shown and, if a jam occurred, B is shown.

Concerning the gloss levels, in all the examples 18 to 21, the gloss levels were low and a section where the decolorable colorant after the decoloring process was fixed was not conspicuous. On the other hand, in the comparative example 5, the gloss level was relatively high and light was reflected on the decolored colorant and the decolored colorant was conspicuous.

Adhesion of the toner and a jam did not occur in all the examples. On the other hand, in the comparative example 6, the roughness Rz value of the surface of the heating belt exceeded 6.0. In some cases, the toner peeled from the sheet and adhered to the belt surface or a jam of the sheet occurred.

As explained in detail above, according to the embodiments explained above, it is possible to provide a decoloring apparatus and an image forming apparatus that can perform a decoloring process for reducing a gloss of a decolorable colorant.

As described in detail in the above, according to the technique described in this specification, a toner which gives a less gloss after decolorization can be provided.

While certain embodiments have been described, these embodiments have been presented by way of example only, and are not intended to limit the scope of invention. Indeed, the novel compound described herein may be embodied in a variety of other forms; furthermore, various omissions, substitutions and changes in the form of the compound described herein may be made without departing from the spirit of the inventions. The accompanying claims and their equivalents are intended to cover such forms or modifications as would fall within the scope and spirit of the inventions.

What is claimed is:

1. An electrophotographic toner, which is decolorized by heating and a glossiness after decolorization of which is less than 10, comprising an electron donating color former compound, an electron accepting color developing agent, and a polyester binder resin.

2. The toner according to claim 1, wherein a weight average molecular weight Mw of the polyester binder resin is 6000 or more and 25000 or less.

3. The toner according to claim 1, wherein the toner has a glass transition point of 35° C. or higher and 65° C. or lower.

4. The toner according to claim 1, wherein the toner has a softening point of 80° C. or higher and 120° C. or lower.

5. The toner according to claim 1, wherein the toner has a toluene insoluble content of 10% by mass or more and 40% by mass or less.

6. The toner according to claim 1, wherein the toner has an acid value of 25 mgKOH/g or less.

7. The toner according to claim 1, further comprising a temperature control agent.

8. The toner according to claim 7, wherein at least the electron donating color former compound, the electron accepting color developing agent, and the temperature control agent are microencapsulated.

9. The toner according to claim 1, wherein the toner is decolorized at a temperature higher than the fixing temperature of the toner.

10. The toner according to claim 1, further comprising at least one type of fine particles having an average primary particle diameter of 50 nm or more and 200 nm or less, wherein the coverage of toner particles of the toner with the fine particles having an average primary particle diameter of 50 nm or more and 200 nm or less is 30% or less per fine particles of one kind of substance, and the coverage of the toner particles with all of the fine particles is 50% or more and 150% or less.

11. The toner according to claim 10, wherein the fine particles comprise any of silica, titania, alumina, strontium titanate, and tin oxide.

12. The toner according to claim 1, wherein the electron donating color former compound is a leuco dye.

13. The toner according to claim 1, wherein the polyester binder resin is a polyester resin obtained by polycondensation of a carboxylic acid component and an alcohol component and has a crosslinked structure formed of a crosslinking component including at least either one of a trivalent or higher valent carboxylic acid and a trihydric or higher hydric alcohol.

14. The toner according to claim 13, wherein the crosslinking component is trimellitic acid.

15. The toner according to claim 14, wherein the crosslinking component is contained in the binder resin in an amount of from 3 to 15 wt %.

16. A toner cartridge containing the electrophotographic toner according to claim 1.

17. An image forming apparatus comprising the electrophotographic toner according to claim 1.

18. An electrophotographic toner, which is decolorizable with heat and a glossiness of which at decolorized state is less than 10, comprising an electron donating color former compound, an electron accepting color developing agent, and a polyester binder resin.

19. The toner according to claim 18, further comprising a temperature control agent.

20. The toner according to claim 19, wherein at least the electron donating color former compound, the electron accepting color developing agent, and the temperature control agent are microencapsulated.

21. The toner according to claim 18, wherein the toner is decolorized with heat which make the temperature control agent heated to a temperature not lower than the melting point of the temperature control agent.

22. A toner cartridge containing the electrophotographic toner according to claim 18.

23. An image forming apparatus comprising the electrophotographic toner according to claim 18.

* * * * *